US011827436B2

(12) United States Patent
Shibuya

(10) Patent No.: US 11,827,436 B2
(45) Date of Patent: Nov. 28, 2023

(54) CARTON AND BLANK THEREFOR

(71) Applicant: WestRock Packaging Systems, LLC, Atlanta, GA (US)

(72) Inventor: Katsuo Shibuya, Tokyo (JP)

(73) Assignee: WestRock Packaging Systems, LLC, Atlanta, GA (US)

( * ) Notice: Subject to any disclaimer, the term of this patent is extended or adjusted under 35 U.S.C. 154(b) by 584 days.

(21) Appl. No.: 16/764,581

(22) PCT Filed: Oct. 25, 2018

(86) PCT No.: PCT/US2018/057509
§ 371 (c)(1),
(2) Date: May 15, 2020

(87) PCT Pub. No.: WO2019/099162
PCT Pub. Date: May 23, 2019

(65) Prior Publication Data

US 2020/0385186 A1 Dec. 10, 2020

Related U.S. Application Data

(60) Provisional application No. 62/587,007, filed on Nov. 16, 2017.

(51) Int. Cl.
*B65D 71/20* (2006.01)

(52) U.S. Cl.
CPC ..... *B65D 71/20* (2013.01); *B65D 2301/10* (2013.01); *B65D 2571/0066* (2013.01);
(Continued)

(58) Field of Classification Search
CPC ..... B65D 71/20; B65D 2571/00925; B65D 2571/00913; B65D 2571/0087;
(Continued)

(56) References Cited

U.S. PATENT DOCUMENTS 3,122,302 A 2/1964 Wood
3,270,944 A 9/1966 Baker
4,044,940 A 8/1977 Helms

FOREIGN PATENT DOCUMENTS

FR 2545062 * 4/1983
WO WO03/004375 A1 1/2003
(Continued)

*Primary Examiner* — Anthony D Stashick
*Assistant Examiner* — Raven Collins
(74) *Attorney, Agent, or Firm* — Brian J. Goldberg; Rohini K. Garg

(57) ABSTRACT

An elongate blank for forming a tubular carton, comprising a plurality of panels including a top panel (18), a first side panel (16), a second side panel (20), a first base panel (12) and a second base panel (24), said each panel being formed along either free end edge thereof with a cut-out so that said blank is provided along either longitudinal edge thereof with a plurality of tabs each interposed between adjacent ones of said cut-outs, said cut-outs including; a first major cut-out (70) struck from each of the opposed free end edges of the top panel, a second major cut-out (70A) struck from each of the opposed free end edges of the first side panel, a third major cut-out (70C) struck from each of the opposed free end edges of the second side panel, a first minor cut-out (70B) struck from each of the opposed free end edges of the first base panel, a second minor cut-out (70D) struck from each of the opposed free end edges of the second base panel, wherein the length (A2) of a portion of one of the free end edges of the first side panel defined by one of the second major cut-outs (70A) is less than the length (C2) of a portion of one of the free end edges of the second side panel defined by one of the third major cut-outs (70C).

14 Claims, 9 Drawing Sheets

(52) U.S. Cl.
CPC ..... *B65D 2571/0087* (2013.01); *B65D 2571/00277* (2013.01); *B65D 2571/00444* (2013.01); *B65D 2571/00561* (2013.01); *B65D 2571/00759* (2013.01)

(58) Field of Classification Search
CPC .. B65D 2571/00753; B65D 2571/0066; B65D 2571/00543
USPC ..... 206/154, 141, 140, 434; 229/40
See application file for complete search history.

(56) References Cited

FOREIGN PATENT DOCUMENTS

| | | | | |
|---|---|---|---|---|
| WO | WO-03004375 A1 * | 1/2003 | ..... | B65D 71/20 |
| WO | WO2005/113368 A1 | 12/2005 | | |

* cited by examiner

CARTON AND BLANK THEREFOR

CROSS-REFERENCE TO RELATED APPLICATIONS

This application is a National Phase application of PCT Application PCT/US18/57509, filed Oct. 25, 2018, which claims the benefit of U.S. Provisional Patent Application No. 62/587,007, filed Nov. 16, 2017, which is incorporated herein by reference in its entirety.

TECHNICAL FIELD

The present invention relates to cartons and to blanks for forming the same. More specifically, but not exclusively, the invention relates to a wraparound carrier formed from nestable blanks.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is desirable to produce cartons from blanks which are nestable, this provides environmental and economic benefits. In packaging systems, it is desirable to automate, with packaging machines, the packaging of the primary product containers into cartons, it is also desirable that the packaging machines are capable of packaging a variety of different primary product containers or carton configurations.

The present invention seeks to provide an improvement in the field of cartons, typically formed from paperboard or the like.

SUMMARY

A first aspect of the invention provides an elongate blank for forming a tubular carton. The blank comprises a plurality of panels including; a top panel, a first side panel, a second side panel, a first base panel and a second base panel. The plurality of panels is arranged in a row along a length of the blank. The plurality of panels is hingedly connected one to another in series. Each of the plurality of panels have a pair of opposed free end edges disposed generally along the length of the blank. Each of the plurality of panels is formed along either free end edge thereof with a cut-out so that said blank is provided along either longitudinal edge thereof with a plurality of tabs each interposed between adjacent ones of said cut-outs. The cut-outs include; a first major cut-out struck from each of the opposed free end edges of the top panel, a second major cut-out struck from each of the opposed free end edges of the first side panel, a third major cut-out struck from each of the opposed free end edges of the second side panel, a first minor cut-out struck from each of the opposed free end edges of the first base panel and a second minor cut-out struck from each of the opposed free end edges of the second base panel. The length of a portion of one of the free end edges of the first side panel defined by one of the second major cut-outs is less than the length of a portion of one of the free end edges of the second side panel defined by one of the third major cut-outs.

Optionally, a first upper tab is hingedly connected in part to one of the first and second side panels and in part to the top panel.

Optionally, a second upper tab is hingedly connected in part to the other one of the first and second side panels and in part to the top panel.

Optionally, a first lower tab is hingedly connected in part to one of the first and second side panels and in part to one of the first and second base panels.

Optionally, a second lower tab is hingedly connected in part to the other one of the first and second side panels and in part to the other one of the first and second base panels.

Optionally, a portion of the first upper tab hinged to one of the first and second side panels is smaller than a portion of the second upper tab is hingedly connected in part to the other one of the first and second side panels.

Optionally, a portion of the first lower tab hingedly connected one of the first and second base panels is smaller than a portion of the second lower tab hingedly connected to the other one of the first and second base panels.

Optionally, the second cut-outs each comprise an upper edge and a lower edge and the third cut-outs each comprise an upper edge and a lower edge, the lower edges of the second cut-outs being disposed at a first distance from an adjacent one of the first and second base panels, the lower edges of the third cut-outs being disposed at a second distance from an adjacent other one of the first and second base panels, the first distance being equal to the second distance.

A second aspect of the invention provides an elongate blank for forming a tubular carton. The blank comprises a plurality of panels including; a top panel, a first side panel hinged to a first side of the top panel, a second side panel hinged to a second side of the top panel, a first base panel hinged to the first side panel and a second base panel hinged to the second side panel. The plurality of panels is arranged in a row along a length of the blank. The plurality of panels are hingedly connected one to another in series. Each of said plurality of panels have a pair of opposed free end edges disposed generally along the length of the blank. Each of said plurality of panels are formed along either free end edge thereof with a cut-out so that said blank is provided along either longitudinal edge thereof with a plurality of tabs each interposed between adjacent ones of said cut-outs. The arrangement of cut-outs and tabs is asymmetrical about a notional line which is transverse to the longitudinal edges and bisects the top panel.

A third aspect of the invention provides a carton for packaging one or more articles. The carton comprises a plurality of walls including; a top wall, a first side wall, a second side wall and a base wall. The carton comprises an article retention structure comprising a first top engaging structure and a second top engaging structure. The first top engaging structure comprises a first upper tab hingedly connected in part to one of the first and second side walls and includes; a first anchoring portion hingedly connected to said one side wall, a first gusset portion hingedly connected to the first anchoring portion, a first web portion hingedly connected to the first gusset portion and a first covering portion provided by a part of the top panel and hingedly connected to the first web portion. The second top engaging structure comprises a second upper tab hingedly connected in part to the other one of the first and second side walls and includes; a second anchoring portion hingedly connected to said other side wall, a second gusset portion hingedly connected to the second anchoring portion, a second web portion hingedly connected to the second gusset portion and a second covering portion provided by a part of the top panel and hingedly connected to the second web portion. The second anchoring portion is larger in dimension than the first anchoring portion.

Optionally, a hinged connection connecting the second anchoring portion to said other side wall is longer than a hinged connection connecting the first anchoring portion to said one side wall.

A fourth aspect of the invention provides a carton for packaging one or more articles. The carton comprises a plurality of walls including; a top wall, a first side wall, a second side wall and a base wall. The carton comprises a cut-out formed along a free end edge of one of the first and second side panels and a further cut-out formed along a free end edge of the other one of the first and second side panels. The further cut-out in said other sidewall has a second height dimension which is greater than a first height dimension of the cut-out in said one sidewall.

A fifth aspect of the invention provides a nested arrangement of blanks, each blank suitable for forming a tubular carton. The nested arrangement comprises at least one column of first blanks and at least one column of second blanks. The first blanks comprise a plurality of panels arranged in a row along a length of the blank and being hingedly connected one to another in series, each of said panels having a pair of opposed free end edges disposed generally along the length of the blank, the plurality of panels including;

- a top panel;
- a first side panel hinged to a first side of the top panel;
- a second side panel hinged to a second side of the top panel;
- a first base panel hinged to the first side panel; and
- a second base panel hinged to the second side panel,
- a cut-out formed along each of the free end edge of each of said panels so that said blank is provided along each longitudinal edge thereof with a plurality of tabs each interposed between adjacent ones of said cut-outs to form a first arrangement of cut-outs and tabs;
- wherein the first arrangement of cut-outs and tabs is asymmetrical about a notional line which is transverse to the longitudinal edges and bisects the top panel. The second blanks comprise a plurality of panels arranged in a row along a length of the blank and being hingedly connected one to another in series, each of said panels having a pair of opposed free end edges disposed generally along the length of the blank, the plurality of panels including;
- a top panel;
- a first side panel hinged to a first side of the top panel;
- a second side panel hinged to a second side of the top panel;
- a first base panel hinged to the first side panel; and
- a second base panel hinged to the second side panel,
- a cut-out formed along each of the free end edge of each of said panels so that said blank is provided along each longitudinal edge thereof with a plurality of tabs each interposed between adjacent ones of said cut-outs to form a second arrangement of cut-outs and tabs;
- wherein the second arrangement of cut-outs and tabs is asymmetrical about a notional line which is transverse to the longitudinal edges and bisects the top panel. In the nested arrangement of blanks the second arrangement of cut-outs and tabs of the second blanks is inverted with respect to the first arrangement of cut-outs and tabs of the first blanks.

A sixth aspect of the invention provides an elongate blank for forming a tubular carton. The blank comprises a plurality of panels including; a top panel, a first side panel, a second side panel, a first base panel and a second base panel, the plurality of panels arranged in a row along a length of the blank. The plurality of panels is hingedly connected one to another in series. Each of the plurality of panels has a pair of opposed free end edges disposed generally along the length of the blank. Each of the plurality of panels is formed along either free end edge thereof with a cut-out so that said blank is provided along either longitudinal edge thereof with a plurality of tabs each interposed between adjacent ones of said cut-outs. The tabs and cut-outs include;

- a first minor cut-out struck from each of the opposed free end edges of the first base panel and having a first linear dimension (D2b);
- a first lower tab formed in part from the first base panel and in part from the first side panel and having a second linear dimension (D1);
- a second major cut-out struck from each of the opposed free end edges of the first side panel and having a third linear dimension (A2);
- a second upper tab formed in part from the first side panel and in part from the top panel and having a fourth linear dimension (C1);
- a first major cut-out struck from each of the opposed free end edges of the top panel and having a fifth linear dimension (B2);
- a first upper tab formed in part from the second side panel and in part from the top panel and having a sixth linear dimension (E1);
- a third major cut-out struck from each of the opposed free end edges of the second side panel and having a seventh linear dimension (C2);
- a second lower tab formed in part from the second base panel and in part from the second side panel and having an eighth linear dimension (A1);
- a second minor cut-out struck from each of the opposed free end edges of the second base panel and having a ninth linear dimension (D2a);

wherein the length of the blank is given by:

$$\text{length}=A1+A2+C1+C2+B1+B2+D2a+D2b+D1$$

and wherein

A1=A2

B1=B2

D1=D2a+D2b

C1=C2

C1>A2

C1>B1

(D2a+A1)=(D2b+D1).

Optionally, the top panel comprises a width dimension (W3), the first minor cut-out and the first lower tab together define a tenth linear dimension (W2), where W2=D2b+D1, the second minor cut-out and the second lower tab together define an eleventh linear dimension (W1), where W1=D2a+A1, the distance between the midpoint of the upper edge of the first lower tab and the fold line coupling the first side panel to the top panel defines a twelfth linear dimension (W5), the distance between the midpoint of the upper edge of the second lower tab and the fold line coupling the second side panel to the top panel defines a thirteenth linear dimension (W4), wherein the length of the blank is given by:

$$\text{length}=W1+W2+W3+W4+W5$$

and where:

$$W4=W5$$

$$W3+W4+W5=C2+B1+B2+C1+A2.$$

Optionally, $$C2+B1=C1+A2$$

and $$B2<W3.$$

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
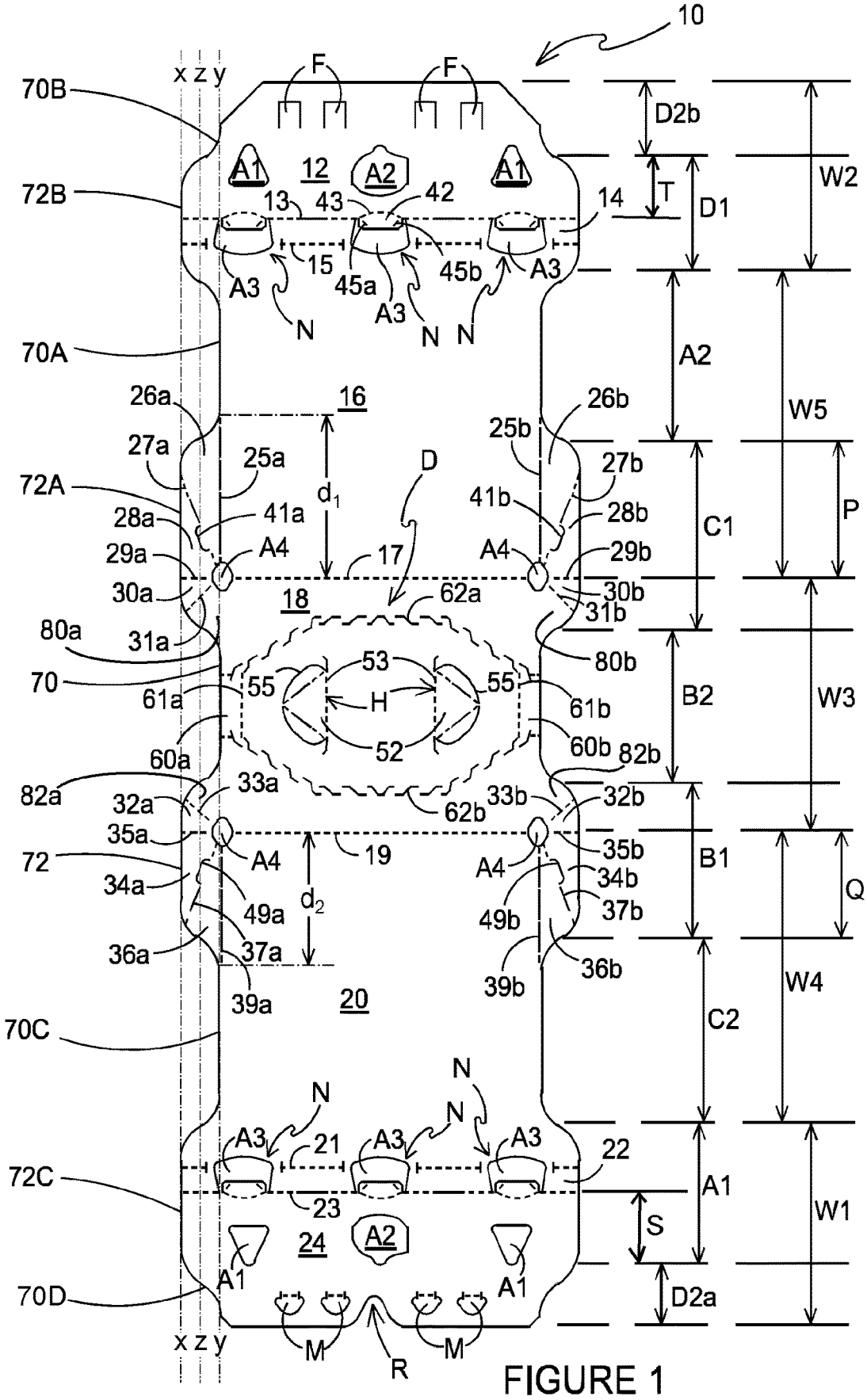
FIG. 1 is a plan view from above of a blank for forming a first carton according to a first embodiment.
Figure 5A:
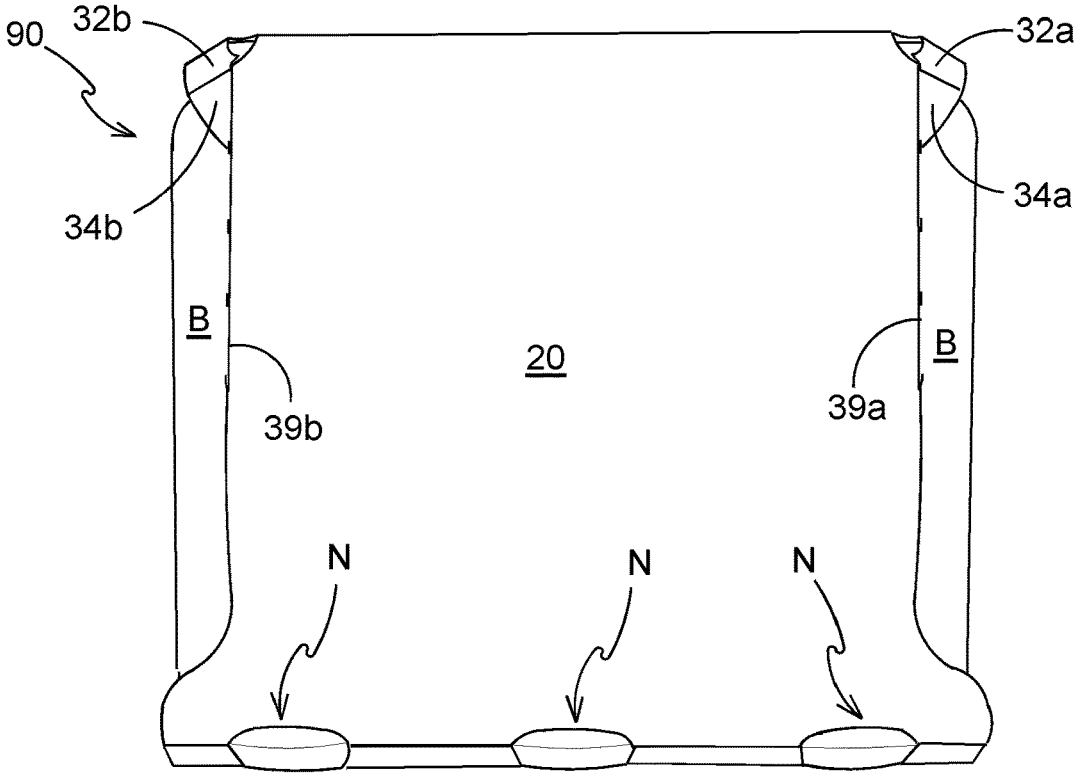
FIG. 5A is a side view of a first side of the first carton formed from the blank of FIG. 1.

Referring to FIG. 1, there is shown a plan view of a blank 10 capable of forming a carton or carrier 90, as shown in FIG. 5A, for containing and carrying a group of primary products such as, but not limited to, beverage cans, hereinafter referred to as articles B, as shown in FIG. 5A. The blank 10 forms a secondary package for packaging at least one primary product container or package.

Figure 2:
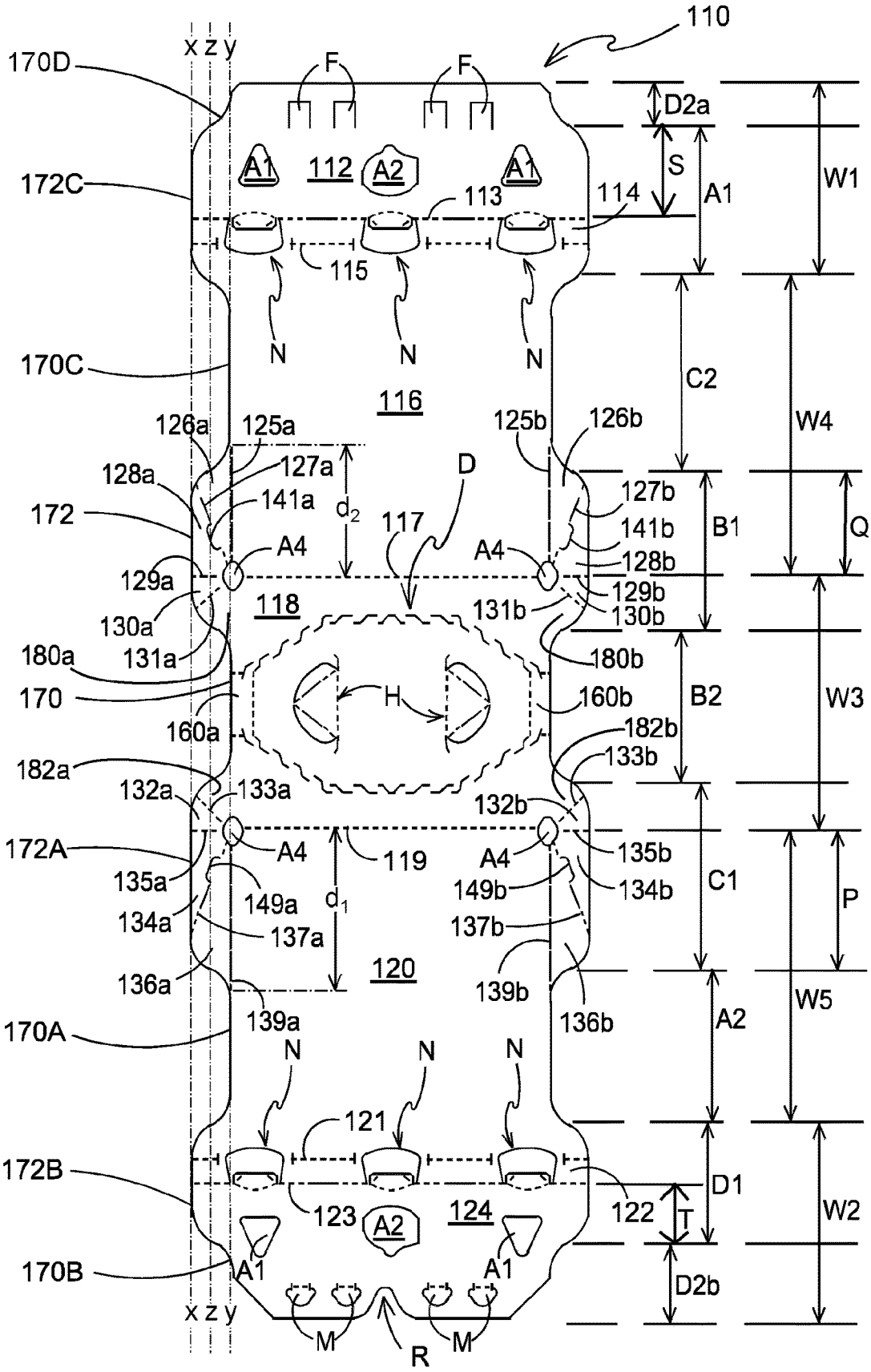
FIG. 2 is a plan view from above of a blank for forming a second carton according to a second embodiment.
Figure 4:
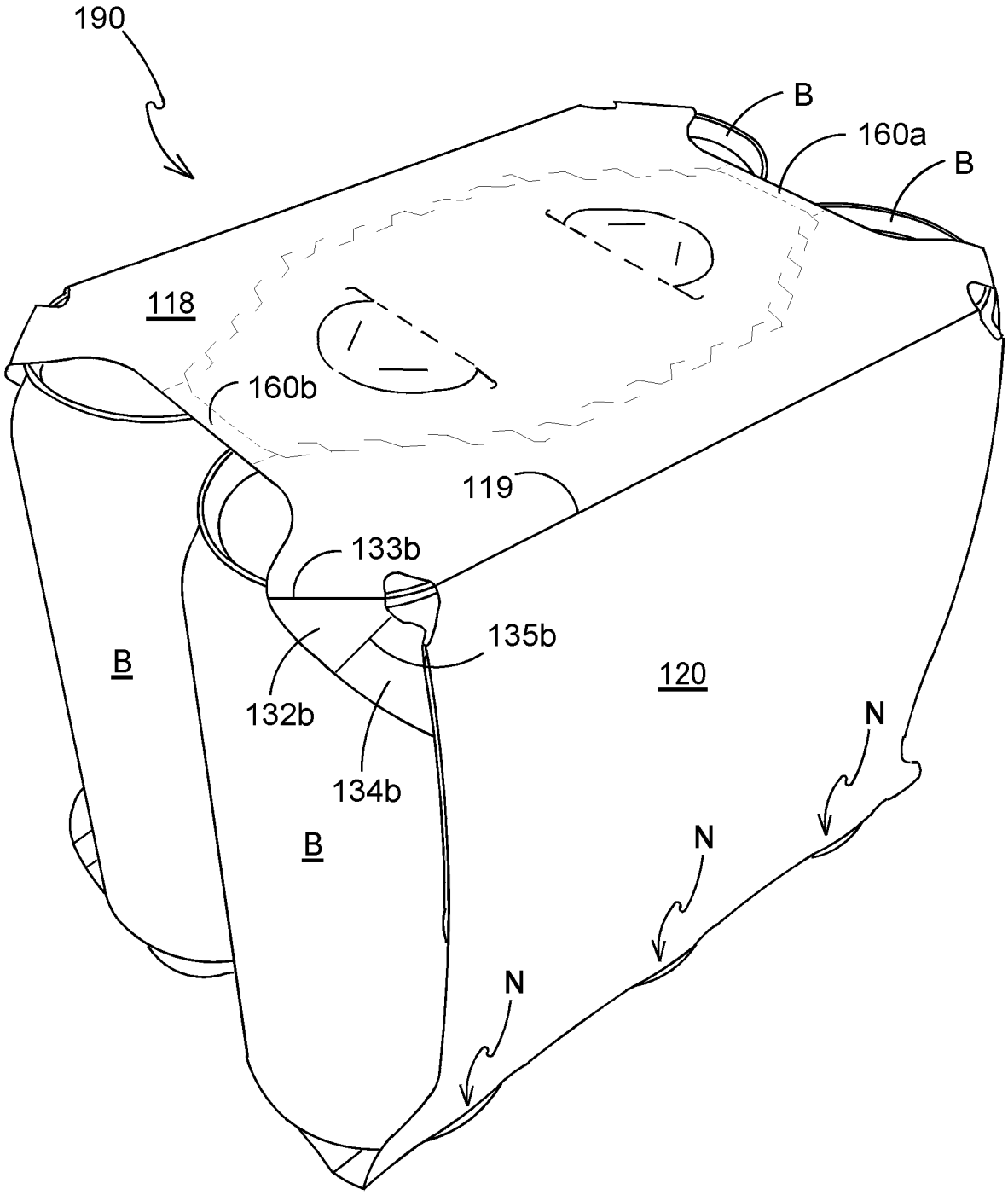
FIG. 4 is a perspective view from above of the second carton formed from the blank of FIG. 2.

Referring to FIG. 2, there is shown a plan view of a blank 110 capable of forming a carton or carrier 190, as shown in FIG. 4, for containing and carrying a group of primary products such as, but not limited to, beverage cans, hereinafter referred to as articles B. The blank 110 forms a secondary package for packaging at least one primary product container or package.

Figure 7:
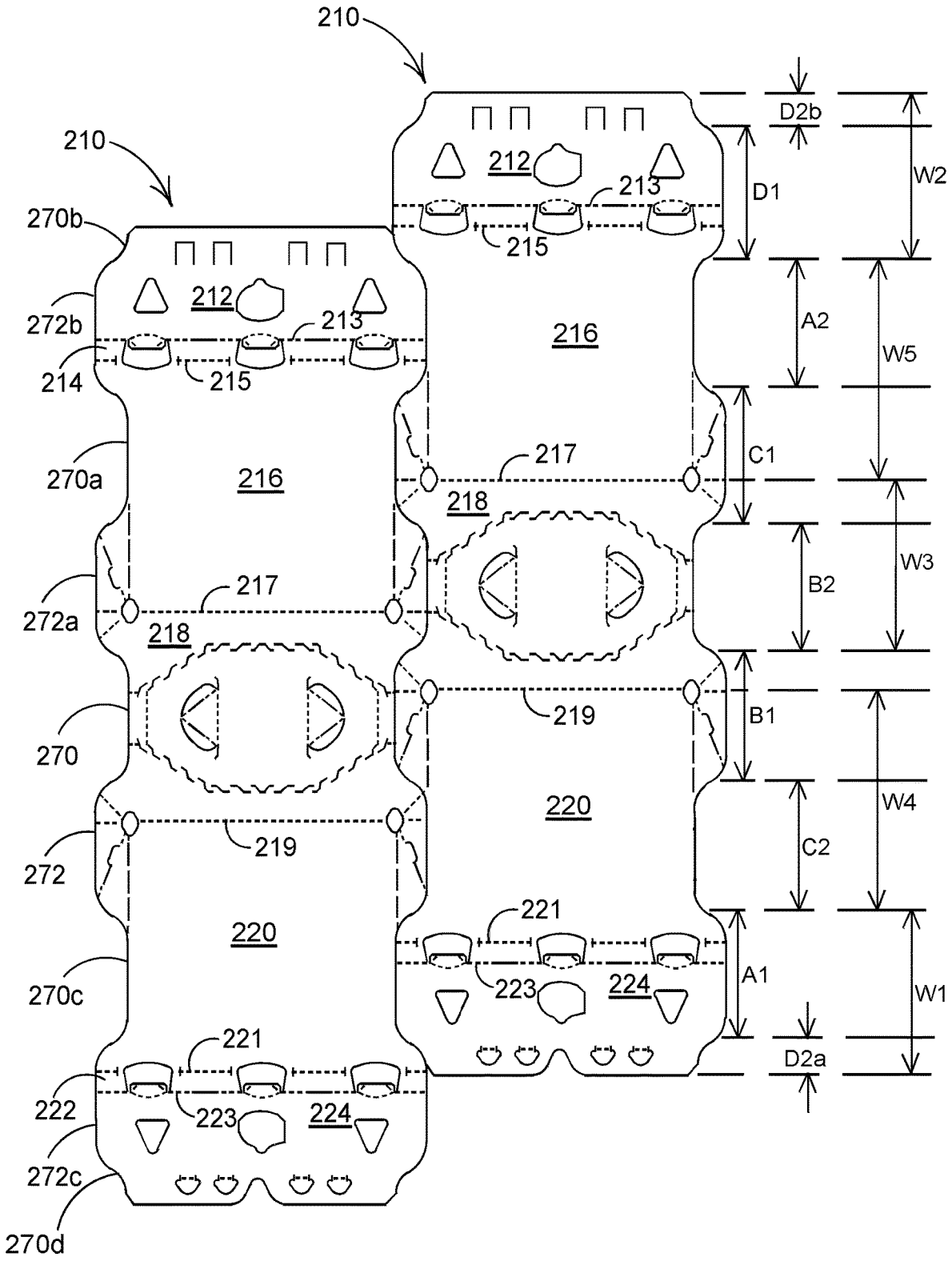
FIG. 7 is a plan view from above of a nested arrangement of a pair of blanks according to a third embodiment.

Referring to FIG. 7, there is shown a plan view of a pair of blanks 210 capable of forming a carton or carrier 290 (see FIG. 8) for containing and carrying a group of alternative primary products or alternative articles, wherein the alternative articles comprise a smaller volume capacity or height dimension than the articles B being packaged by the blanks 10; 110 of FIGS. 1 and 2.

In the embodiments detailed herein, the terms "carton" and "carrier" refer, for the non-limiting purpose of illustrating the various features of the invention, to a container 90, 190 for engaging and carrying articles B, such as primary product containers B. It is contemplated that the teachings of the invention can be applied to various product containers B, which may or may not be tapered and/or cylindrical. Other exemplary containers include bottles (for example metallic, glass or plastics bottles), cans (for example aluminium cans), tins, cups, pots, pouches, packets and the like.

The blanks 10; 110; 210 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structure or carton 90; 190; 290 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blanks 10; 110 are configured to form a carton or carrier 90; 190 for packaging an exemplary arrangement of exemplary articles B. In the illustrated embodiments the arrangement is an m×n matrix or array, having two rows (m=2) and three columns (n=3); in the illustrated embodiments two rows of three articles B are provided, and the articles B are 500 ml beverage cans. The blank 210 is configured to form a carton or carrier for packaging an exemplary arrangement of exemplary articles, in two rows of three articles B, and wherein the articles are 330 ml beverage cans. Alternatively, the blanks 10; 110; 210 can be configured to form a carrier for packaging other types, number and size of articles B and/or for packaging articles B in a different arrangement or configuration for example, but not limited to, fully enclosed cartons or basket carriers, the articles B may be bottles or cans.

Beverage cans are typically produced in standard sizes, the cans are typically defined by their volume and/or by their diameter. For example, commonly used sizes include, but are not limited to, those shown in Table 1 below.

TABLE 1

| Can Sizes | | |
|---|---|---|
| Volume Metric | Volume Imperial | Can Body Diameter |
| 222 ml | 7.5 oz | 58 mm |
| 237 ml | 8 oz | 58 mm |
| 269 ml | 9.1 oz | 58 mm |
| 290 ml | 9.8 oz | 58 mm |
| 296 ml | 10 oz | 58 mm |
| 300 ml | 10.1 oz | 58 mm |
| 310 ml | 10.4 oz | 58 mm |
| 330 ml | 11.3 oz | 58 mm |
| 355 ml | 12 oz | 58 mm |
| 425 ml | 14.4 oz | 58 mm |
| 237 ml | 8 oz | 66 mm |
| 250 ml | 8.4 oz | 66 mm |
| 300 ml | 10.1 oz | 66 mm |
| 310 ml | 10.4 oz | 66 mm |
| 330 ml | 11.2 oz | 66 mm |
| 375 ml | 12.7 oz | 66 mm |
| 440 ml | 14.9 oz | 66 mm |
| 500 ml | 16.9 oz | 66 mm |
| 333 ml | 11.3 oz | 66 mm |
| 355 ml | 12 oz | 66 mm |
| 473 ml | 16 oz | 66 mm |
| 500 ml | 16.9 oz | 66 mm |
| 550 ml | 18.6 oz | 66 mm |
| 568 ml | 19.2 oz | 66 mm |

As Table 1 shows a beverage cans of different volumes may have a common diameter dimension. In order to increase or decrease the volume of a beverage can of a given diameter the height of the beverage can is adjusted—taller cans providing a larger volume.

It is desirable to package beverage cans of different volume dimensions upon a single packaging machine. It will be appreciated that a blank adapted for packaging cans of a first volume will be differently sized compared to a blank adapted for packaging cans of a second different volume.

Such changes in dimension of the blank have in the past required reconfiguration of a packaging machine in order to package cartons that vary in size. Or alternatively have required a separate machine for each can or carton size. Given the size, cost, and complexity of these machines, this undesirable.

Therefore, it is advantageous to design carton and/or carton blanks for packaging cans or articles which vary in size but which cartons/blanks do not require reconfiguration of the packaging machine or provision of a separate packaging machine.

It is also desirable that the blanks comprise a footprint which can be nested or tessellated, such that the blanks can be cut from sheet material, minimising waste. When doing so it is desirable to be able to minimise the number of cutting blades required for cutting the blanks from the sheet material, it is therefore desirable to employ a single blade to separate a first blank from an adjacent neighbour; it is therefore desirable to tessellate the first blank with its neighbours.

Turning to FIG. 1, there is illustrated a blank 10 for forming a carton 90 (see FIG. 5A) according to a first embodiment. The blank 10 comprises a plurality of main panels 12, 14, 16, 18, 20, 22, 24 for forming a tubular structure. The plurality of main panels 12, 14, 16, 18, 20, 22, 24 comprises; a first base panel 12, a first corner panel 14, a first side panel 16, a top panel 18, a second side panel 20, a second corner panel 22 and a second base panel 20. The plurality of panels 12, 14, 16, 18, 20, 22, 24 may be arranged in a linear series hinged one to the next by corresponding fold lines 13, 15, 17, 19, 21, 23.

In alternative embodiments, the first and second corner panels 14, 22 may be omitted, the fold lines 15, 21 may be omitted.

The first and second corner panels 14, 22 may be considered to form lower portions of the respective one of the first or second side panels 16, 20 to which they are hingedly connected.

The blank 10 is foldable to form a package 90 as illustrated in FIG. 5A. The first and second base panels 12, 24 are engageable with one another in an overlapping relationship to form a composite base wall 12/24 of the carton 90. The blank 10 may comprise a complementary locking mechanism for securing the second base panel 24 to the first base panel 12. The first base panel 12 may comprise at least one first part F of the complementary locking mechanism. The second base panel 24 may comprise at least one second part M of the complementary locking mechanism. In the illustrated embodiment, the first base panel 12 comprises a plurality of female tabs F defining openings in the first base panel 12. The second base panel 24 comprises a plurality of male tabs M, the openings in the first base panel 12 being configured to receive a respective one of the male tabs M. The female tabs F are arranged to be displaced out of the first base panel 12 to form the opening and to bear against the male tabs M when received therein. In some embodiments the complementary locking mechanism M/F may be omitted, the first and second base panels 12, 24 may be secured to each other by other means such as but not limited to adhesive or staples.

Optionally, the first and second base panels 12, 24 may comprise at least one first aperture A1. In the illustrated embodiment, each of the first and second base panels 12, 24 comprises two first apertures A1. Optionally, the first and second base panels 12, 24 may comprise at least one second aperture A2. In the illustrated embodiment, each of the first and second base panels 12, 24 comprises one second aperture A2. The first and second apertures A1, A2 may be employed to facilitate construction of the carton 90. A packaging machine component may engage with the first and second apertures A1, A2 to enable the plurality of panels 12, 14, 16, 18, 20, 22, 24 to be tightened about a group of articles B. The first and second apertures A1, A2 may also be employed to facilitate alignment of the first and second base panels 12, 24 with respect to each other or to align the first part of the complementary locking mechanism with the second part of the complementary locking mechanism. The complementary locking mechanism illustrated and described is entirely optional.

The blank 10 may comprise at least one heel engagement structure N for engaging with a heel or lower portion of an article B. The blank 10 illustrated in FIG. 1 comprises six heel engagement structures N each is provided for engaging a respective article B. Each of the heel engagement structures N is substantially similar in construction and will be described by reference to a heel engagement structure N provided in the first side panel 16.

The heel engagement structure N may comprise an opening. The opening is defined in part by a heel aperture A3 and in part by a heel tab 42. The heel tab 42 is hingedly connected to the first base panel by fold line 43. The heel tab 42 is struck from the first corner panel 14.

The fold line 43 interrupts the fold line 13 hingedly connecting the first base panel 12 to the first corner panel 14. The fold line 43 may be non-linear, in the illustrated embodiment the fold line 43 is curved or arcuate in shape, in other embodiments it may be formed from at least two linear cut lines divergently arranged with respect to each other and contiguous with each other.

The heel tab 42 may comprise a pair of divergently arranged fold lines 45*a*, 45*b* which may define foldable corner portions of the heel tab 42.

The top panel 18 may comprise an optional handle structure H. The handles structure H comprises a pair of foldable finger tabs 52. The finger tabs 52 are spaced apart from each other. The finger tabs 52 are hingedly connected to the top panel 18 by fold lines 53 and are defined in part by a cut line or severance line 55. A first one of the finger tabs 52 is hingedly connected to the top panel 18 in opposition to a second one of the finger tabs 52.

The top panel 18 may comprise a detachable portion D in the form of a tear strip. The detachable portion D is defined by a first tear or severance line 62*a* and by a second tear or severance line 62*b*. The first and second severance lines 62*a*, 62*b* extend generally longitudinally across the top panel 18 from a first free end edge to a second, opposing, free end edge. The second severance line 62*b* is laterally spaced apart from the first severance line 62*a*. A tear initiation device in the form of a pull tab 60*a*, 60*b* may be provided at each end of the tear strip. The pull tabs 60*a*, 60*b* are hingedly connected to the tear strip by respective fold lines 61*a*, 61*b*, and may be defined in part by weakened lines which are more readily torn than the first and second severance lines 62*a*, 62*b*, that is to say the weakened lines offer less tear resistance than the first and second severance lines 62*a*, 62*b*.

The detachable portion D may facilitate access to the contents, articles B, of the carton 90 upon removal thereof.

Each of the panels 12, 16, 18, 20, 24 is formed with a pair of cut-outs or recesses. The cut-outs are defined in opposed end edges of the blank 10. The cut-outs comprise full, major cut-outs 70, 70A, 70C and partial or minor cut-outs 70B, 70D.

A first cut-out 70 is defined in the top panel 18 around the midway along each of its opposed end edges. A second cut-out 70A is defined in each end edge of the first side panel 16. A third cut-out 70C is defined in each end edge of the second side panel 20.

A partial or minor cut-out 70B/70D is defined in each of the opposed end edges of each of the first and second base panels 12, 24.

As a result, the blank 10 is provided along either longitudinal edge thereof with four tabs 72, 72A, 72B, 72C each interposed between adjacent ones of the cut-outs 70, 70A, 70B, 70C, 70D.

As illustrated in FIG. 1, a first upper tab 72 is sandwiched and defined by the adjacently disposed first and third cut-outs 70, 70C. A second upper tab 72A is sandwiched and defined by the first and second cut-outs 70, 70A. A first lower tab 72B is sandwiched and defined by the second cut-out 70A and by a first one of the partial cut-outs 70B, defined in the first base panel 12. A second lower tab 72C is sandwiched and defined by the third cut-out 70C and by a second one of the partial cut-outs 70D, defined in the second base panel 24.

The first upper tab 72 is positioned astride the adjacent fold line 19. The second upper tab 72A is positioned astride the adjacent fold line 17.

The first lower tab 72B is positioned astride the adjacent fold lines 13, 15. The second lower tab 72C is positioned astride the adjacent fold lines 21, 23.

The first partial cut-out 70B, in the first base panel 12, comprises a first linear dimension D2b, wherein the first linear dimension D2b is defined between a free side edge (a shorter, transverse, edge of the blank 10) of the first base panel 12 and a midpoint on a shoulder or a lower edge of the first lower tab 72B.

The aforementioned midpoint or lower edge is defined as the point at which a first notional line z-z shown in FIG. 1 intersects the outline of the first lower tab 72B.

The first notional line z-z is parallel to a second notional line x-x and a third notional line y-y; the first notional line z-z is disposed equidistant from the second notional line x-x and from the third notional line y-y. The second notional line x-x lies on or is defined by the free end of each of the four tabs 72, 72A, 72B, 72C. The third notional line y-y lies on or is defined by the end or bottom of each of the cut-outs 70, 70A, 70B, 70C, 70D. The first, second and third notional lines z-z, x-x, y-y are shown in FIGS. 1 and 2. The length, length dimension or linear dimension of each of the tabs 72, 72A, 72B, 72C and cut-outs is measured along the first notional line z-z. The length, length dimension or linear dimension E1, C1, D1, A1 of each tab 72, 72A, 72B, 72C is defined between the opposite shoulders of the respective tab, each shoulder being defined as the point at which the first notional line z-z intersects the outline of the respective tab. The length, length dimension or linear dimension B2, A2, C2 of each of the first, second and third cut-outs 70, 70A, 70C is defined between the shoulders of the respective two sandwiching tabs whereas the length or length dimension D2b, D2a of each partial cut-out 70B, 70D is defined between the adjacent free end edge of the blank 10 and the adjacent shoulder or lower edge of the respective lower tab 72B, 72C.

The first lower tab 72B comprises a second linear dimension D1, wherein the second linear dimension D1 is defined between the midpoint of the lower edge of the first lower tab 72B and a midpoint on a shoulder or an upper edge of the first lower tab 72B.

The second cut-out 70A comprises a third linear dimension A2, wherein the third linear dimension A2 is defined between the midpoint of the upper edge of the first lower tab 72B and a midpoint on a shoulder or a lower edge of the second upper tab 72A.

The second upper tab 72A comprises a fourth linear dimension C1, wherein the fourth linear dimension C1 is defined between the midpoint of the lower edge of the second upper tab 72A and a midpoint on a shoulder or an upper edge of the second upper tab 72A.

The first cut-out 70 comprises a fifth linear dimension B2, wherein the fifth linear dimension B2 is defined between the midpoint of the upper edge of the second upper tab 72A and a midpoint on a shoulder or an upper edge of the first upper tab 72.

The first upper tab 72 comprises a sixth linear dimension E1, wherein the sixth linear dimension 1 is defined between the midpoint of the upper edge of the first upper tab 72 and a midpoint on a shoulder or a lower edge of the first upper tab 72.

The third cut-out 70C comprises a seventh linear dimension C2, wherein the seventh linear dimension C2 is defined between the midpoint of the lower edge of the first upper tab 72 and a midpoint on a shoulder or an upper edge of the second lower tab 72C.

The second lower tab 72C comprises an eighth linear dimension A1, wherein the eighth linear dimension A1 is defined between the midpoint of the upper edge of the second lower tab 72C and a midpoint on a shoulder or a lower edge of the second lower tab 72C.

The second partial cut-out 70D, in the second base panel 24, comprises a ninth first linear dimension D2a, wherein the ninth linear dimension D2a is defined between a midpoint on a shoulder or a lower edge of the second lower tab 72C and a free side edge of the second base panel 24.

The full or major cut-outs 70, 70A, 70C are capable of accommodating an appropriately sized one of the tabs 72, 72A, 72C. For example, the first cut-out 70 is complementary to first upper tab 72, the second cut-out 70A is complementary to second lower tab 72C and the third cut-out 70C is complementary to second upper tab 72A.

Each of the partial or minor cut-outs 70B, 70D cooperates with a partial or minor cut-outs 70B, 70D of an adjacent blank 10 so as to provide a void capable of accommodating an appropriately sized tab 72B. A first partial cut-out 70B from a first blank 10 and a second partial cut-out 70D from a second adjacent blank 10 are required to accommodate a single tab 72B. In this way two partial cut-outs 70B, 70D may be considered to form a full cut-out that is complementary to first lower tab 72B.

Each of the first and second upper tabs 72 and 72A forms, or assists in forming of, an end retention structure for preventing the contents of the carton 90 from dislodging from the carton 90 when said blank 10 is erected into the carton 90. Each of the first and second upper tabs 72 and 72A is provided with cut and fold lines to form a top-engaging structure when it is folded along the fold lines.

More specifically, each upper tab 72, 72A comprises an anchoring portion 26*a*, 26*b*, 36*a*, 36*b* hingedly connected to the adjacent side panel 16, 20 along a fold line 25*a*, 35*b*, 39*a*, 39*b*. Each upper tab 72, 72A comprises a gusset portion 28*a*, 28*b*, 34*a*, 34*b* hingedly connected to the anchoring portion 26*a*, 26*b*, 36*a*, 36*b* along a fold line 27*a*, 27*b*, 37*a*, 37*b*.

Each upper tab 72, 72A comprises a web portion 30*a*, 30*b*, 32*a*, 32*b* hingedly connected to the gusset portion 28*a*, 28*b*, 34*a*, 34*b* along an extension 29*a*, 29*b*, 35*a*, 35*b* of respective one of the fold lines 17, 19. Each upper tab 72, 72A comprises a covering portion 80*a*, 80*b*, 82*a*, 82*b* that is integrally formed with the top panel 18. Each web portion 30*a*, 30*b*, 32*a*, 32*b* is hingedly connected to the respective covering portion 80*a*, 80*b*, 82*a*, 82*b* by a fold line 31*a*, 31*b*, 33*a*, 33*b*.

An optional aperture A4 may be struck in part from the top panel 18, in part from one of the first or second side panels 16, 20 and in part from one of the upper tabs 72, 72A. The apertures A4 define a terminus of the fold lines 17, 19; 29*a*, 29*b*, 35*a*, 35*b*; 31*a*, 31*b*, 33*a*, 33*b*; 27*a*, 27*b*, 37*a*, 37*b*; 25*a*, 35*b*, 39*a*, 39*b* and wherein apertures A4 are disposed at a vertex of aforesaid fold lines 17, 19; 29*a*, 29*b*, 35*a*, 35*b*; 31*a*, 31*b*, 33*a*, 33*b*; 27*a*, 27*b*, 37*a*, 37*b*; 25*a*, 35*b*, 39*a*, 39*b*.

Folding of each upper tab 72, 72A is achieved during the erection of the carton. To form a top engaging structure out of each upper tab 72, 72A, the anchoring portion 26*a*, 26*b*, 36*a*, 36*b* is folded about 180 degrees to bring it into a face-contacting relationship with the inside surface of the adjacent side panel 16, 20. The anchoring portion 26*a*, 26*b*, 36*a*, 36*b* is held in the folded position by being pressed by one of the packaged articles B against the adjacent side panel 16, 20. The folding of the anchoring portion 26*a*, 26*b*, 36*a*, 36*b* causes the gusset portion 28*a*, 28*b*, 34*a*, 34*b* to be folded outwardly about the fold line 27*a*, 27*b*, 37*a*, 37*b* so that the gusset portion 28*a*, 28*b*, 34*a*, 34*b* extends outwardly from the fold line 27*a*, 27*b*, 37*a*, 37*b* along the side wall of the one packaged article B. At the same time, the web portion 30*a*, 30*b*, 32*a*, 32*b* is caused to fold downwardly along the fold line 31*a*, 31*b*, 33*a*, 33*b* and is thereby brought to a folded position where it extends between the fold line 31*a*, 31*b*, 33*a*, 33*b* and the outer edge of the gusset portion 28*a*, 28*b*, 34*a*, 34*b*. The top-engaging structure thus completed is illustrated in FIG. 5A wherein the structure is shown as tightly engaging the top of the one article B.

Each lower tab 72B, 72C serves to provide sufficient material in which the adjacent endmost heel aperture A3 is defined. More particularly, the heel aperture A3 adjacent to each lower tab 72B, 72C is positioned such that sufficient material surrounds the heel aperture A3 even when the heel aperture A3 extends into that lower tab 72B, 72C. During the erection and packaging of articles B, the blank 10 is manipulated so that each heel aperture A3 receives the bottom of a respective article B to retain said article B within the carton 90. The heel tabs 42 are also folded to assist in retaining the articles B.

The top panel 18 comprises a width dimension W3 defined between fold line 17 and fold line 19.

The first partial cut-out 70B and the first lower tab 72B together define a tenth linear dimension W2 where W2=D2b+D1.

The second partial cut-out 70D and the second lower tab 72C together define an eleventh linear dimension W1 where W1=D2a+A1.

The tenth linear dimension W2 is equal to the eleventh linear dimension W1.

The distance between the midpoint of the shoulder or upper edge of the first lower tab 72B and the fold line 17, coupling the first side panel 16 to the top panel 18, defines a twelfth linear dimension W5.

The distance between the midpoint of the shoulder or upper edge of the second lower tab 72C and the fold line 19, coupling the second side panel 20 to the top panel 18, defines a thirteenth linear dimension W4.

The thirteenth linear dimension W4 is equal to the twelfth linear dimension W5.

The length of the blank 10 defined between the free side edge of the first base panel 12 and the free side edge of the second base panel 24, that is to say between the short, transverse, edges of the blank 10, is given by Equation 1 below:

$$\text{length}=A1+A2+C1+C2+B1+B2+D2a+D2b+D1 \qquad \text{Equation 1}$$

where,

A1=A2=B1=B2

D2a+D2b=D1

C1=C2
C1>A2
C1>B1
C2>A2
C2>B1

The length of the blank 10, between the free side edge of the first base panel 12 and the free side edge of the second base panel 24, is alternatively defined by Equation 2 below:

$$\text{length}=W1+W2+W3+W4+W5 \quad \text{Equation 2}$$

where,

W4=W5
W1=(D2a+A1)=(D2b+D1)=W2
W4=W5
W3+W4+W5=C2+B1+B2+C1+A2
C2+B1=C1+A2
B2<W3

Turning to FIG. 2, there is illustrated a blank 110 for forming a carton 190 (see FIG. 4) according to a second embodiment. The blank 110 comprises a plurality of main panels 112, 114, 116, 118, 120, 122, 124 for forming a tubular structure. The plurality of main panels 112, 114, 116, 118, 120, 122, 124 comprises; a first base panel 112, a first corner panel 114, a first side panel 116, a top panel 118, a second side panel 120, a second corner panel 122 and a second base panel 20. The plurality of panels 112, 114, 116, 118, 120, 122, 124 may be arranged in a linear series hinged one to the next by corresponding fold lines 113, 115, 117, 119, 121, 123.

The blank 110 is foldable to form a package 190 as illustrated in FIG. 4. The first and second base panels 112, 124 are engageable with one another in an overlapping relationship to form a composite base wall 112/124 of the carton 190. The blank 110 may comprise a complementary locking mechanism for securing the second base panel 124 to the first base panel 112. The first base panel 112 may comprise at least one first part F of the complementary locking mechanism. The second base panel 124 may comprise at least one second part M of the complementary locking mechanism. In some embodiments the complementary locking mechanism M/F may be omitted, the first and second base panels 112, 124 may be secured to each other by other means such as but not limited to adhesive or staples.

Optionally, the first and second base panels 112, 124 may comprise at least one first aperture A1. In the illustrated embodiment, each of the first and second base panels 112, 124 comprises two first apertures A1. Optionally, the first and second base panels 112, 124 may comprise at least one second aperture A2. In the illustrated embodiment, each of the first and second base panels 112, 124 comprises one second apertures A2. The first and second apertures A1, A2 may be employed to facilitate construction of the carton 190.

The blank 110 may comprise at least one heel engagement structure N for engaging with a heel or lower portion of an article B. The blank 110 illustrated in FIG. 2 comprises six heel engagement structures N each is provided for engaging a respective article B. Each of the heel engagement structures N is substantially similar in construction to those of the embodiment of FIG. 1 and will not be described in further detail.

The top panel 118 may comprise an optional handle structure H. The handles structure H comprises a pair of foldable finger tabs 152. The finger tabs 152 are spaced apart from each other. The finger tabs 152 are hingedly connected to the top panel 118 by fold lines 153 and are defined in part by a cut line or severance line 155. A first one of the finger tabs 152 is hingedly connected to the top panel 118 in opposition to a second one of the finger tabs 152.

The top panel 118 may comprise a detachable portion D in the form of a tear strip. The detachable portion D is substantially similar in construction to that of the embodiment of FIG. 1 and will not be described in further detail.

Each of the panels 112, 116, 118, 120, 124 is formed with a pair of cut-outs or recesses. The cut-outs are defined in opposed end edges of the blank 110.

A first cut-out 170 is defined in the top panel 118 around the midway along each of its opposed end edges. A second cut-out 170A is defined in each end edge of the second side panel 120. A third cut-out 170C is defined in each end edge of the first side panel 116.

A partial cut-out 170B, 170D is defined in each of the opposed end edges of each of the first and second base panels 112, 124.

As a result, the blank 110 is provided along either longitudinal edge thereof with four tabs 172, 172A, 172B, 172C each interposed between adjacent ones of the cut-outs 170, 170A, 170B, 170C, 170D.

As illustrated in FIG. 2, a first upper tab 172 is sandwiched and defined by the adjacently disposed first and third cut-outs 170, 170C. A second upper tab 172A is sandwiched and defined by the first and second cut-outs 170, 170A. A first lower tab 172B is sandwiched and defined by the second cut-out 170A and by a first partial cut-out 170B, defined in the second base panel 124. A second lower tab 172C is sandwiched and defined by the third cut-out 170C and by a second partial cut-out 170D, defined in the first base panel 112.

The first upper tab 172 is positioned astride the adjacent fold line 117. The second upper tab 172A is positioned astride the adjacent fold line 119.

The first lower tab 172B is positioned astride the adjacent fold lines 121, 123. The second lower tab 172C is positioned astride the adjacent fold lines 113, 115.

The first partial cut-out 170B, in the second base panel 124, comprises a first linear dimension D2b, wherein the first linear dimension D2b is defined between a free side edge (a short, transverse, edge of blank 110) of the second base panel 124 and a midpoint on a shoulder or a lower edge of the first lower tab 172B.

The first lower tab 172B comprises a second linear dimension D1, wherein the second linear dimension D1 is defined between the midpoint of the lower edge of the first lower tab 172B and a midpoint on a shoulder or an upper edge of the first lower tab 172B.

The second cut-out 170A comprises a third linear dimension A2, wherein the third linear dimension A2 is defined between the midpoint of the upper edge of the first lower tab 172B and a midpoint on a shoulder or a lower edge of the second upper tab 172A.

The second upper tab 172A comprises a fourth linear dimension C1, wherein the fourth linear dimension C1 is defined between the midpoint of the lower edge of the second upper tab 172A and a midpoint on a shoulder or an upper edge of the second upper tab 172A.

The first cut-out 170 comprises a fifth linear dimension B2, wherein the fifth linear dimension B2 is defined between the midpoint of the upper edge of the second upper tab 172A and a midpoint on a shoulder or an upper edge of the first upper tab 172.

The first upper tab 172 comprises a sixth linear dimension E1, wherein the sixth linear dimension B1 is defined between the midpoint of the upper edge of the first upper tab 172 and a midpoint on a shoulder or a lower edge of the first upper tab 172.

The third cut-out 170C comprises a seventh linear dimension C2, wherein the seventh linear dimension C2 is defined between the midpoint of the lower edge of the first upper tab 172 and a midpoint on a shoulder or an upper edge of the second lower tab 172C.

The second lower tab 172C comprises an eighth linear dimension A1, wherein the eighth linear dimension A1 is defined between the midpoint of the upper edge of the second lower tab 172C and a midpoint on a shoulder or a lower edge of the second lower tab 172C.

The second partial cut-out 170D, in the first base panel 112, comprises a ninth first linear dimension D2a, wherein the ninth linear dimension D2a is defined between a midpoint on a shoulder or a lower edge of the second lower tab 172C and a free side edge of the first base panel 112.

The top panel 118 comprises a width dimension W3 defined between fold line 17 and fold line 19.

The first partial cut-out 170B and the first lower tab 172B together define a tenth linear dimension W2, W2=D2b+D1.

The second partial cut-out 170D and the second lower tab 172B together define an eleventh linear dimension W1, W1=D2a+A1.

The tenth linear dimension W2 is equal to the eleventh linear dimension W1.

The distance between the midpoint of the shoulder or upper edge of the first lower tab 172B and the fold line 119, coupling the second side panel 120 to the top panel 118, defines a twelfth linear dimension W5.

The distance between the midpoint of the shoulder or upper edge of the second lower tab 172C and the fold line 117, coupling the first side panel 116 to the top panel 118, defines a thirteenth linear dimension W4.

The thirteenth linear dimension W4 is equal to the twelfth linear dimension W5.

The length of the blank 110 defined between the free side edge of the first base panel 112 and the free side edge of the second base panel 124, that is to say between the short, transverse, edges of the blank 110, is given by Equation 3 below:

$$\text{length}=A1+A2+C1+C2+B1+B2+D2a+D2b+D1 \qquad \text{Equation 3}$$

where,

A1=A2=B1=B2
D2a+D2b=D1
C1=C2
C1>A2
C1>B1
C2>A2
C2>B1

The length of the blank 110, between the free side edge of the first base panel 112 and the free side edge of the second base panel 124, is alternatively defined by Equation 4 below:

$$\text{length}=W1+W2+W3+W4+W5 \qquad \text{Equation 4}$$

where,

W4=W5
W1=(D2a+A1)=(D2b+D1)=W2
W4=W5
W3+W4+W5=C2+B1+B2+C1+A2
C2+B1=C1+A2
B2<W3

Each of the first and second upper tabs 172 and 172A forms, or assists in forming of, an end retention structure for preventing the contents of the carton 190 from dislodging from the carton 190 when said blank 110 is erected into the carton 190. Each of the first and second upper tabs 172 and 172A is provided with cut and fold lines to form a top-engaging structure when it is folded along the fold lines.

More specifically, each upper tab 172, 172A comprises an anchoring portion 126*a*, 126*b*, 136*a*, 136*b* hingedly connected to the adjacent side panel 116, 120 along a fold line 125*a*, 135*b*, 139*a*, 139*b*. Each upper tab 172, 172A comprises a gusset portion 128*a*, 128*b*, 134*a*, 134*b* hingedly connected to the anchoring portion 126*a*, 126*b*, 136*a*, 136*b* along a fold line 127*a*, 127*b*, 137*a*, 137*b*.

Each upper tab 172, 172A comprises a web portion 130*a*, 130*b*, 132*a*, 132*b* hingedly connected to the gusset portion 128*a*, 128*b*, 134*a*, 134*b* along an extension 129*a*, 129*b*, 135*a*, 135*b* of respective one of the fold lines 17, 19. Each upper tab 72, 72A comprises a covering portion 180*a*, 180*b*, 182*a*, 182*b* that is integrally formed with the top panel 18. Each web portion 130*a*, 130*b*, 132*a*, 132*b* is hingedly connected to the respective covering portion 180*a*, 180*b*, 182*a*, 182*b* by a fold line 131*a*, 131*b*, 133*a*, 133*b*.

Folding of each upper tab 172, 172A is achieved during the erection of the carton 190. To form a top engaging structure out of each upper tab 172, 172A, the anchoring portion 126*a*, 126*b*, 136*a*, 136*b* is folded about 180 degrees to bring it into a face-contacting relationship with the inside surface of the adjacent side panel 116, 120. The anchoring portion 126*a*, 126*b*, 136*a*, 136*b* is held in the folded position by being pressed by one of the packaged articles B against the adjacent side panel 116, 120. The folding of the anchoring portion 126*a*, 126*b*, 136*a*, 136*b* causes the gusset portion 128*a*, 128*b*, 134*a*, 134*b* to be folded outwardly about the fold line 127*a*, 127*b*, 137*a*, 137*b* so that the gusset portion 128*a*, 128*b*, 134*a*, 134*b* extends outwardly from the fold line 127*a*, 127*b*, 137*a*, 137*b* along the side wall of the one packaged article B. At the same time, the web portion 130*a*, 130*b*, 132*a*, 132*b* is caused to fold downwardly along the fold line 131*a*, 131*b*, 133*a*, 133*b* and is thereby brought to a folded position where it extends between the fold line 131*a*, 131*b*, 133*a*, 133*b* and the outer edge of the gusset portion. The top-engaging structure thus completed is illustrated in FIG. 5A wherein the structure is shown as tightly engaging the top of the one article B.

Each lower tab 172B, 172C serves to provide sufficient material in which the adjacent end most heel aperture A3 is defined. More particularly, the heel aperture A3 adjacent to each lower tab 172B, 172C is positioned such that sufficient material surrounds the heel aperture A3 even when the heel aperture A3 extends into that lower tab 172B, 172C. During the erection and packaging of articles B, the blank 110 is manipulated so that each heel aperture A3 receives the bottom of a respective article B to retain said article B within the carton 190. The heel tabs 142 are also folded to assist in retaining the articles B.

The top panel 118 comprises a width dimension W3 defined between fold line 117 and fold line 119.

The first partial cut-out 170B and the first lower tab 172B together define a tenth linear dimension W2 where W2=D2b+D1.

The second partial cut-out 170D and the second lower tab 172B together define an eleventh linear dimension W1 where W1=D2a+A1.

The tenth linear dimension W2 is equal to the eleventh linear dimension W1.

The distance between the midpoint of the shoulder or upper edge of the first lower tab 172B and the fold line 119, coupling the second side panel 120 to the top panel 118, defines a twelfth linear dimension W5.

The distance between the midpoint of the shoulder or upper edge of the second lower tab 172C and the fold line 117, coupling the first side panel 116 to the top panel 118, defines a thirteenth linear dimension W4.

The thirteenth linear dimension W4 is equal to the twelfth linear dimension W5.

The arrangement of the cut-outs 170, 170A, 170B, 170C, 170D and tabs 172, 172A, 172B, 172C of the blank 110 of FIG. 2 has been inverted with respect to the arrangement of the cut-outs 70, 70A, 70B, 70C, 70D and tabs 72, 72A, 72B, 72C of the blank 10 of FIG. 1.

The way the arrangement of the cut-outs 170, 170A, 170B, 170C, 170D and tabs 172, 172A, 172B, 172C of the blank 110 has been inverted may be described differently and more specifically as follows:

The position of the second and third cut-outs 170A, 170C has been swapped such that the second cut-out 170A is now struck from the second side panel 120, whereas in the embodiment of FIG. 1, the cut-out 70A was struck from the first side panel 16. Similarly, the third cut-out 170C is now struck from the first side panel 116, whereas in the embodiment of FIG. 1, the third cut-out 70C was struck from the second side panel 20.

The position of the first and second partial cut-outs 170B, 170D has been swapped such that the first partial cut-out 170B is now struck from the second base panel 124, whereas in the embodiment of FIG. 1, the first partial cut-out 70B was struck from the first base panel 12. Similarly, the second partial cut-out 170D is now struck from the first base panel 112, whereas in the embodiment of FIG. 1, the second partial cut-out 70D was struck from the second side panel 24.

The position of the first cut-out 170 remains unchanged and is struck from the top panel 118 of the blank 110 whereas in the embodiment of FIG. 1, the first cut-out 70 was struck from the top panel 18.

The position of the first and second upper tabs 172 and 172A has also been swapped such that the second upper tab 172A is now astride the fold line 119 whereas in the embodiment of FIG. 1, the second upper tab 72A was astride the fold line 17. Similarly, the first upper tab 172 is now astride the fold line 117 whereas in the embodiment of FIG. 1, the first upper tab 72 was astride the fold line 19. Additionally, the position of the first and second lower tabs 172B and 172C has been swapped such that the second lower tab 172C is now astride the fold lines 113, 115 whereas in the embodiment of FIG. 1, the second lower tab 72C was astride the fold lines 21, 23. Similarly, the first lower tab 172B is now astride the fold lines 121, 123 whereas in the embodiment of FIG. 1, the first lower tab 72B was astride the fold lines 13, 15.

Referring to FIG. 7, there is illustrated a blank 210 for forming a carton 290 (see FIG. 8) according to another embodiment. The blank 210 comprises a plurality of main panels 212, 214, 216, 218, 220, 222, 224 for forming a tubular structure. The plurality of main panels 212, 214, 216, 218, 220, 222, 224 comprises; a first base panel 212, a first corner panel 214, a first side panel 216, a top panel 218, a second side panel 220, a second corner panel 222 and a second base panel 20. The plurality of panels 212, 214, 216, 218, 220, 222, 224 may be arranged in a linear series hinged one to the next by corresponding fold lines 213, 215, 217, 219, 221, 223.

The blank 210 is substantially similar in construction to those of the embodiments of FIG. 1 and FIG. 2 and only the differences between the blank 210 of FIG. 7 and blanks 10; 110 of FIGS. 1 and 2 will be described in further detail.

Each of the panels 212, 214, 216, 218, 220, 222, 224 is formed with a pair of cut-outs or recesses. The cut-outs are defined in opposed end edges of the blank 210.

A first cut-out 270 is defined in the top panel 218 around the midway along each of its opposed end edges. A second cut-out 270*a* is defined in each end edge of the first side panel 216. A third cut-out 270*c* is defined in each end edge of the second side panel 220.

A partial cut-out 270*b*, 270*d* is defined in each of the opposed end edges of each of the first and second base panels 212, 224.

As a result, the blank 210 is provided along either longitudinal edge thereof with four tabs 272, 272*a*, 272*b*, 272*c* each interposed between adjacent ones of the cut-outs 270, 270*a*, 270*b*, 270*c*, 270*d*.

A first upper tab 272 is sandwiched and defined by the adjacently disposed first and third cut-outs 270, 270*c*. A second upper tab 272A is sandwiched and defined by the first and second cut-outs 270, 270*a*. A first lower tab 272*b* is sandwiched and defined by the second cut-out 270*a* and by a first one of the partial cut-outs 270*b*, defined in the first base panel 212. A second lower tab 272*c* is sandwiched and defined by the third cut-out 270C and by a second one of the partial cut-outs 270*d*, defined in the second base panel 224.

The first upper tab 272 is positioned astride the adjacent fold line 219. The second upper tab 272*a* is positioned astride the adjacent fold line 217.

The first lower tab 272*b* is positioned astride the adjacent fold lines 213, 215. The second lower tab 272*c* is positioned astride the adjacent fold lines 221, 223.

The first partial cut-out 270*b*, in the first base panel 212, comprises a first linear dimension D2b, wherein the first linear dimension D2b is defined between a free side edge (a short, transverse, edge the blank 210) of the first base panel 212 and a midpoint on a shoulder or a lower edge of the first lower tab 272*b*.

The first lower tab 272*b* comprises a second linear dimension D1, wherein the second linear dimension D1 is defined between the midpoint of the lower edge of the first lower tab 272*b* and a midpoint on a shoulder or an upper edge of the first lower tab 272*b*.

The second cut-out 270*a* comprises a third linear dimension A2, wherein the third linear dimension A2 is defined between the midpoint of the upper edge of the first lower tab 272*b* and a midpoint on a shoulder or a lower edge of the second upper tab 272*a*.

The second upper tab 272*a* comprises a fourth linear dimension C1, wherein the fourth linear dimension C1 is defined between the midpoint of the lower edge of the second upper tab 272*a* and a midpoint on a shoulder or an upper edge of the second upper tab 272*a*.

The first cut-out 270 comprises a fifth linear dimension B2, wherein the fifth linear dimension B2 is defined between the midpoint of the upper edge of the second upper tab 272*a* and a midpoint on a shoulder or an upper edge of the first upper tab 272.

The first upper tab 272 comprises a sixth linear dimension E1, wherein the sixth linear dimension 1 is defined between the midpoint of the upper edge of the first upper tab 272 and a midpoint on a shoulder or a lower edge of the first upper tab 272.

The third cut-out 270*c* comprises a seventh linear dimension C2, wherein the seventh linear dimension C2 is defined between the midpoint of the lower edge of the first upper tab 272 and a midpoint on a shoulder or an upper edge of the second lower tab 272*c*.

The second lower tab 272*c* comprises an eighth linear dimension A1, wherein the eighth linear dimension A1 is defined between the midpoint of the upper edge of the second lower tab 272*c* and a midpoint on a shoulder or a lower edge of the second lower tab 272*c*.

The second partial cut-out 270*d*, in the second base panel 224, comprises a ninth first linear dimension D2a, wherein the ninth linear dimension D2a is defined between a midpoint on a shoulder or a lower edge of the second lower tab 272*c* and a free side edge of the second base panel 224.

The second, fourth, sixth and eighth linear dimensions D1, C1, E1, A1 are equal in magnitude.

The third, fifth and seventh linear dimensions A2, B2, C2 are equal in magnitude.

The second, fourth, sixth and eighth linear dimensions D1, C1, E1, A1 and the third, fifth and seventh linear dimensions A2, B2, C2 are equal in magnitude, in this way the tabs 272, 272*a*, 272*b*, 272*c* are complementary to the cut-outs 270, 270*a*, 270*b*, 270*c*, 270*d*. This enables identical blanks 210 to be nested without being inverted.

The tenth linear dimension W2 and the eleventh linear dimension W1 of blanks 10; 110; 210 are maintained at a constant magnitude for beverage cans or articles B having a common body diameter irrespective of their volume capacity. That is to say, the tenth linear dimension W2 of blanks 10; 110 is equal in magnitude to the tenth linear dimension W2 of blank 210 despite the fact that the blanks 10; 110 are adapted to accommodate larger articles B. Similarly, the eleventh linear dimension W1 of blanks 10; 110 is equal in magnitude to the eleventh linear dimension W1 of blank 210.

Figure 8:
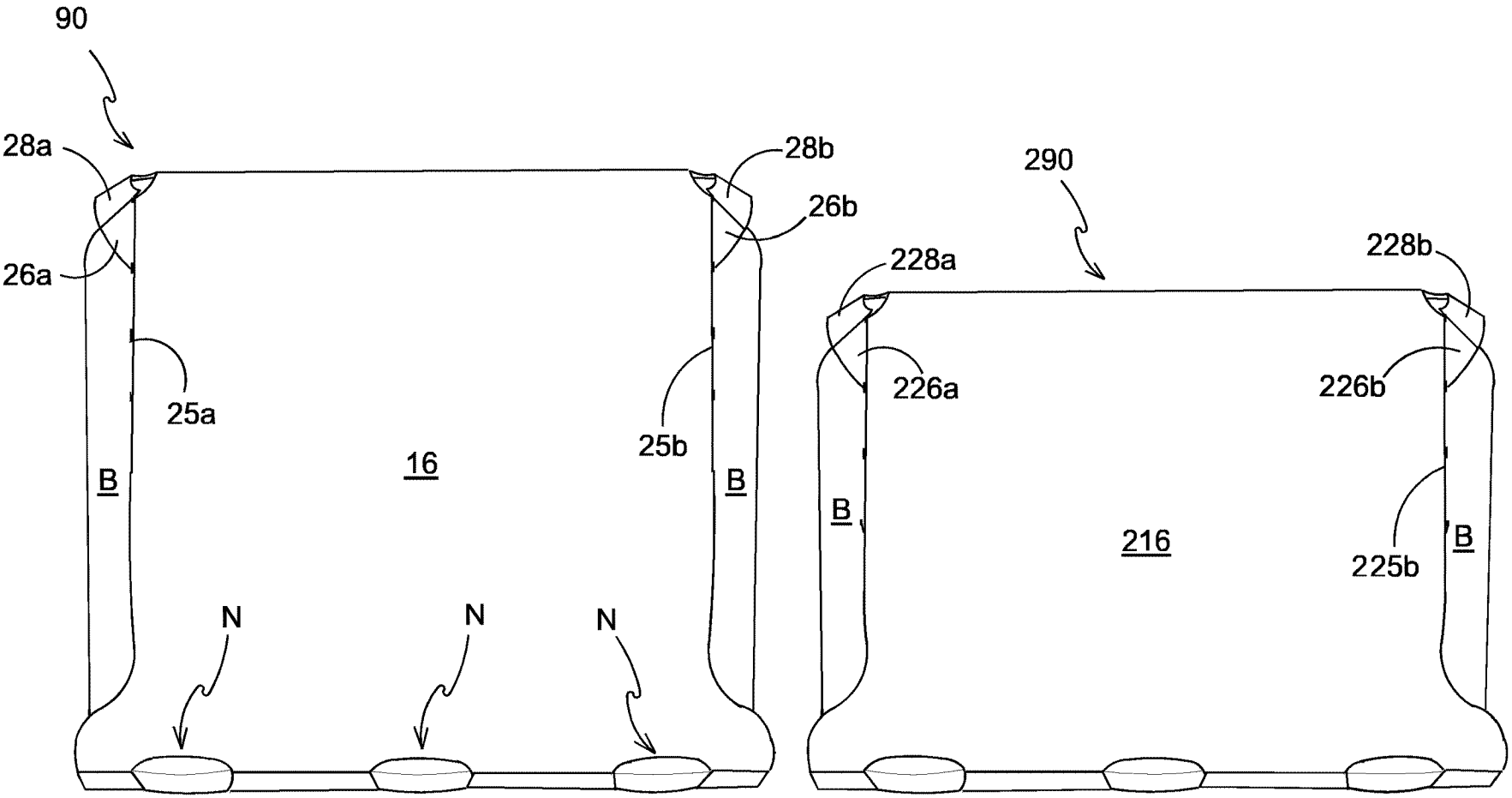
FIG. 8 is a side view of a second side of the first carton formed from the blank of FIG. 1 and a second side of a third carton formed from a blank according to FIG. 7.

In this way the upper shoulders or edges of the first and second lower tabs 72B, 72C; 172B, 172C; 272*b*, 272*c* are maintained at a constant elevation above the base wall 12/24; 112/124; 212/224 of the carton 90; 190; 290 irrespective of the volume capacity of the articles B, as illustrated by FIG. 8.

This is advantageous since a packaging machine can employ a flight bar or lug to engage with a group of articles B to transfer the group of articles B or a package comprising the group of articles B and a carton 90; 190 in a downstream direction during processing of the group of articles B or package. The height or elevation of the flight bar or lug with respect to the articles B need not be adjusted so that the packaging machine can accommodate articles B of different volume capacities. In one non-limiting example, the packaging machine may be employed to package 330 ml beverage cans having a diameter of 66 mm or to package 500 ml beverage cans having a diameter of 66 mm. The blanks 10; 110 of FIGS. 1 and 2 may be employed to package the 500 ml beverage cans. The blank 210 of FIG. 7 may be employed to package the 330 ml beverage cans. FIG. 8 illustrates a first carton 90 formed from a blank 10 according to FIG. 1 side by side with a third carton 290 formed from a blank 210 according to FIG. 7. FIG. 8 clearly shows that a recess in the first side wall 16 of the first carton 90 is arranged to commence at the same elevation above the base wall 12/24 as recess in a first side wall 216 of the third carton 290. In this way the blanks 10, 210 and/or first and third cartons 90, 290 can be handled and manipulated to form packages on the same packaging machine.

Similarly, the width dimension W3 of the top panel 18; 118; 218 is maintained at a constant magnitude for beverage cans or articles B having a common body diameter irrespective of their volume capacity.

The magnitude of the thirteenth linear dimension W4 and magnitude of the twelfth linear dimension W5 of the blanks 10; 110; 210 is adapted, increased or decreased, accordingly in dependence upon the volume capacity or height dimension of the articles B to be packaged by the carton 90; 190; 290.

Whereas the arrangement of the tabs 272, 272*a*, 272*b*, 272*c* and cut-outs 270, 270*a*, 270*b*, 270*c*, 270*d* of the blank 210 is symmetrical about an axis bisecting the top panel 218 and extending parallel to the fold lines 217, 219. The blanks 10; 110 are in contrast asymmetrical, about an axis bisecting the top panel 18; 118 and extending parallel to the fold lines 17, 19; 117, 119. The first upper tab 72, 172 is smaller in length or height than the second upper tab 72A, 172A. The first lower tab 72B, 172B is smaller in length or height than the second lower tab 72C, 172C. The second cut-out 70A, 170A is smaller in length or height than the third cut-out 70C, 170C. The second partial cut-out 70D, 170D is smaller in length or height than the first partial cut-out 70B, 170B.

Figure 5B:
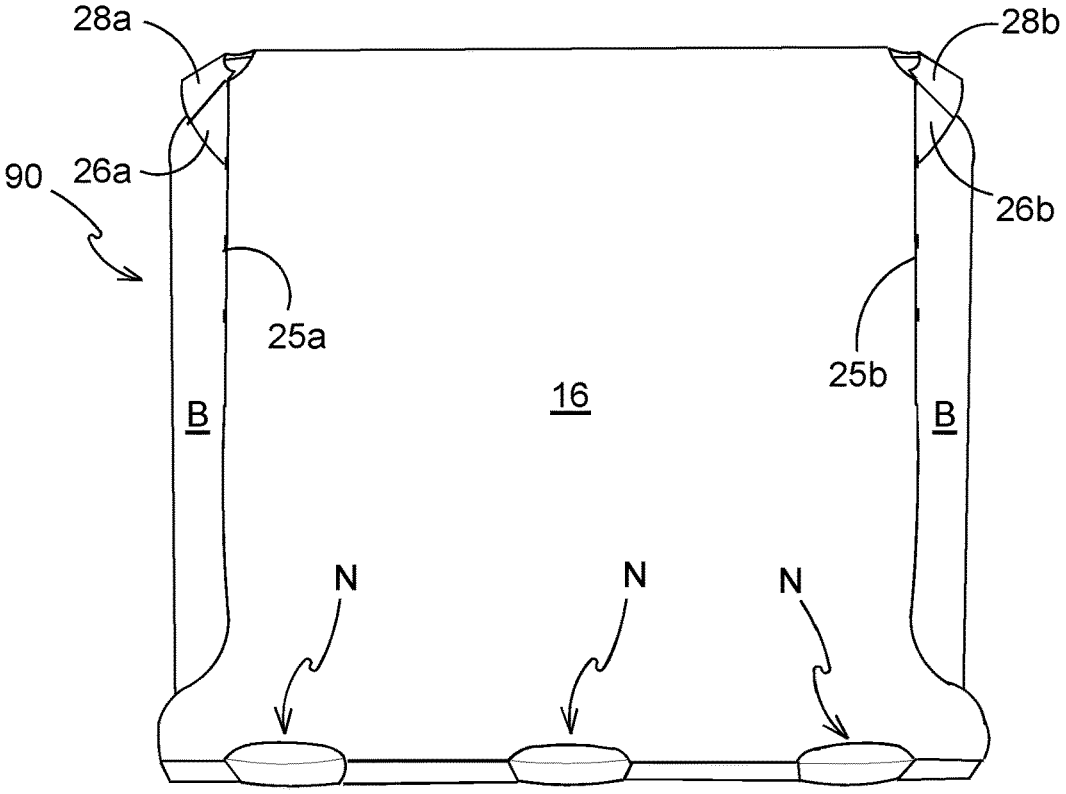
FIG. 5B is a side view of a second side of the first carton formed from the blank of FIG. 1.

FIG. 5A shows a first side view of the carton 90 formed from the blank 10 of FIG. 1, FIG. 5B shows a second side view of the carton 90 formed from the blank 10 of FIG. 1. The fold lines 39*a*, 39*b* are shorter in length than the fold lines 25*a*, 25*b*.

Figure 6A:
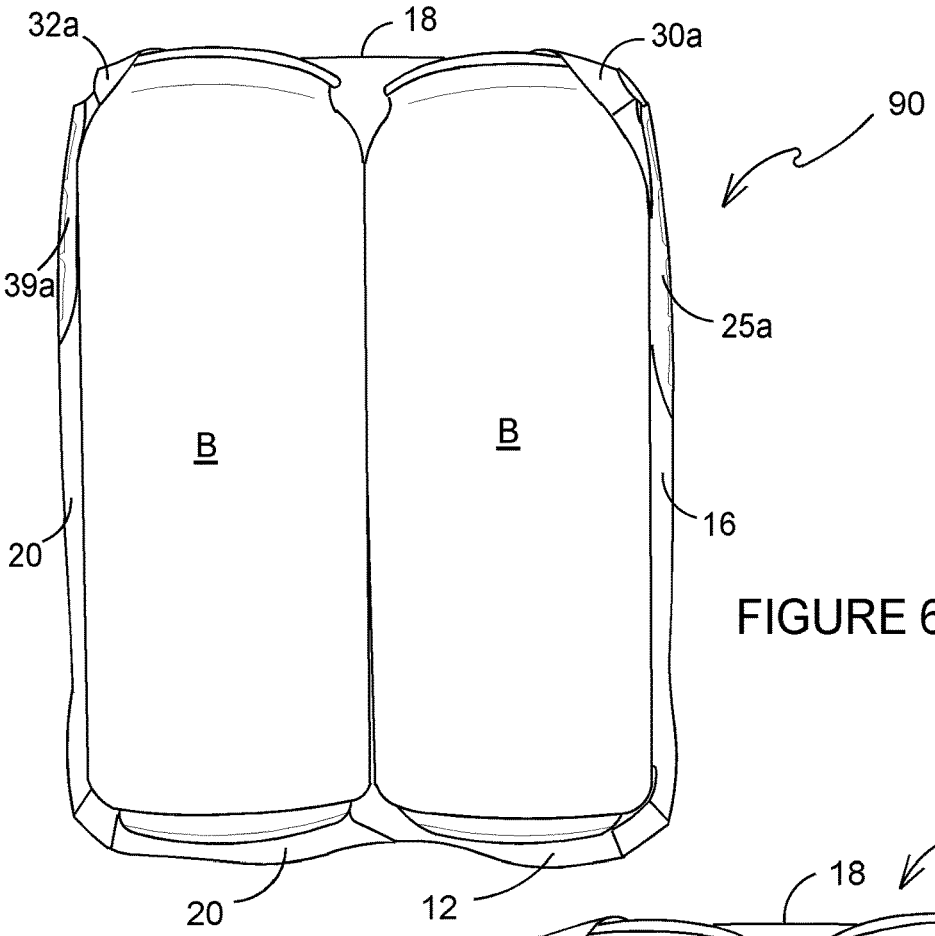
FIG. 6A is an end view of a first end of the first carton formed from the blank of FIG. 1.
Figure 6B:
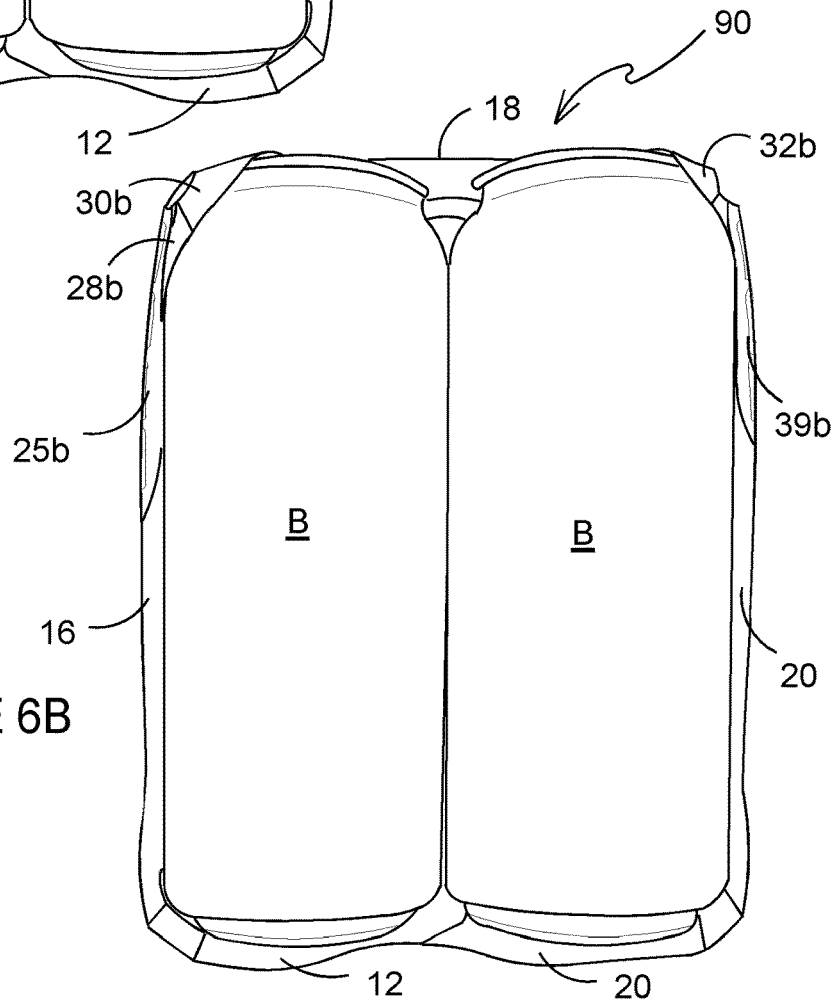
FIG. 6B is an end view of a second end of the first carton formed from the blank of FIG. 1.

FIG. 6A shows a first end view of the carton 90 formed from the blank 10 of FIG. 1, FIG. 5B shows a second end view of the carton 90 formed from the blank 10 of FIG. 1. The anchoring portions 36*a*, 36*b* are hinged to second side panel 20 by fold lines 39*a*, 39*b* respectively, the anchoring portions 26*a*, 26*b* are hinged to first side panel 20 by fold lines 25*a*, 25*b* respectively, are longer in length than the fold lines 25*a*, 25*b*. The anchoring portion 36*a* and the fold line 39*a* are shorter than the anchoring portion 26*a* and the fold line 25*a*. The anchoring portion 36*b* and the fold line 39*b* are shorter than the anchoring portion 26*b* and the fold line 25*b*.

FIGS. 1 and 2 show that each anchoring portion 26*a*, 26*b*, 36*a*, 36*b*; 126*a*, 126*b*, 136*a*, 136*b* and the respective gusset portion 28*a*, 28*b*, 34*a*, 34*b*; 128*a*, 1128*b*, 134*a*, 134*b* to which it is hinged define or form a portion of the respective one of the first and second upper tabs 72, 72A, 172, 172A which is hingedly connected to a first or second side panel 16, 20; 116, 120 respectively.

The portion of the first upper tab 72; 172 hinged to the respective side panel 20; 116 has a length dimension indicated by reference sign "Q" in FIGS. 1 and 2. The portion of the second upper tab 72A; 172A hinged to the respective side panel 16; 120 has a length dimension indicated by reference sign "P" in FIGS. 1 and 2.

The fold line 25*a*, 25*b*; 139*a*, 139*b* connecting the anchoring portion 26*a*, 26*b*; 136*a*, 136*b* of the second upper tab 72A; 172A to the respective side panel 16; 120 has a length dimension indicated by reference sign "$d_1$" in FIGS. 1 and 2.

The fold line 39*a*, 39*b*; 125*a*, 125*b* connecting the anchoring portion 36*a*, 36*b*; 126*a*, 126*b* of the first upper tab 72; 172 to the respective side panel 16; 120 has a length dimension indicated by reference sign "$d_2$" in FIGS. 1 and 2.

The length T of a portion of the first lower tab 72B, 172B connected to the respective one 12, 124 of the first and second base panels is less than the length S of a portion of the second lower tab 72C, 172C connected to the respective other one 24, 112 of the first and second base panels.

The second cut-outs 70A, 170A each has an upper edge and a lower edge and the third cut-outs 70C, 170C each has an upper edge and a lower edge. Each of the lower edges of the second cut-outs 70A, 170A is disposed at a first distance (D1−T) from the adjacent one 12, 124 of the first and second base panels. Each of the lower edges of the third cut-outs 70C, 170C is disposed at a second distance (A1–S) from the adjacent other one 24, 112 of the first and second base panels. The first distance (D1–T) is equal to the second distance (A1–S).

Figure 3:
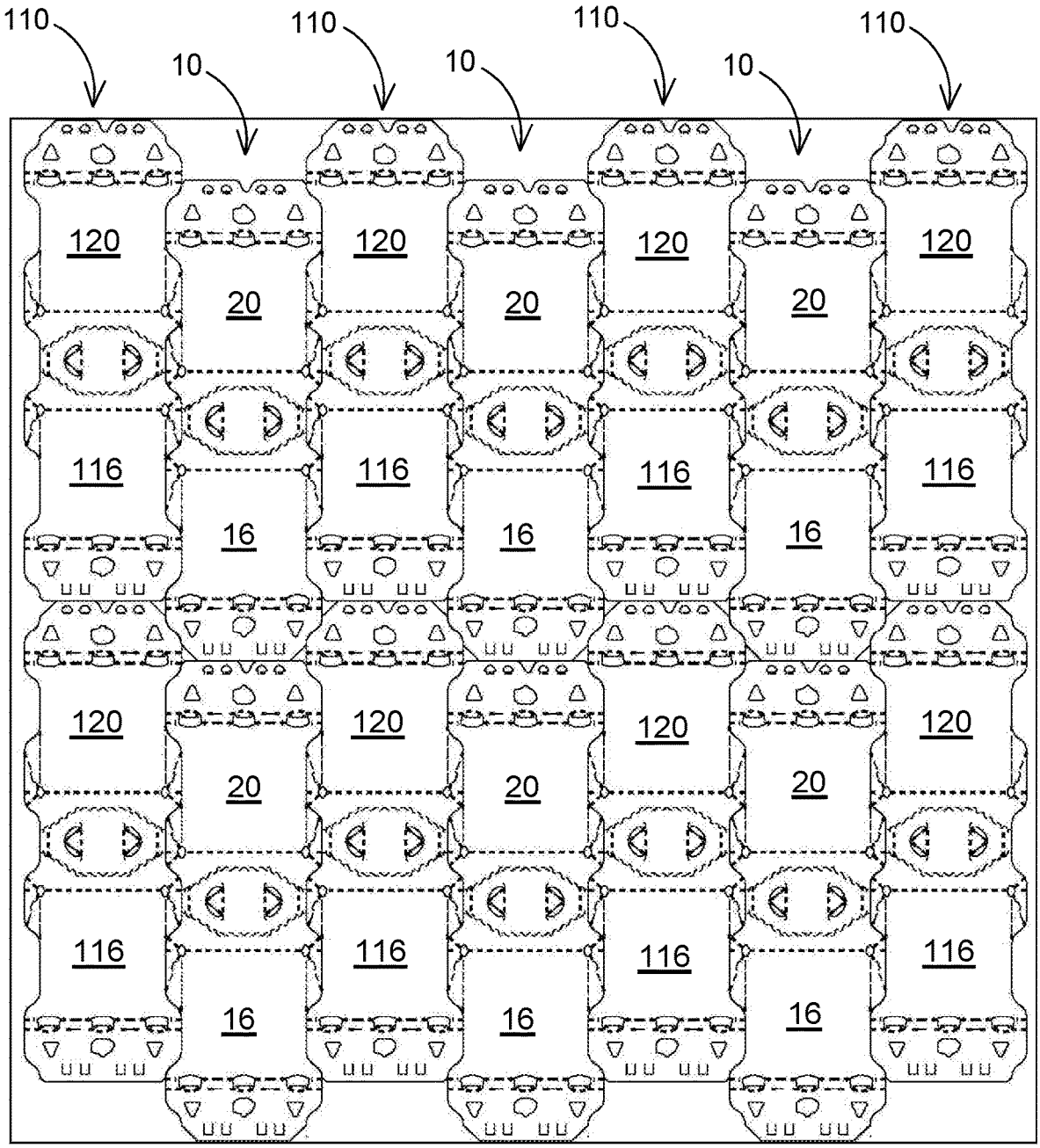
FIG. 3 is a plan view from above of a nested arrangement of first blanks according to FIG. 1 with second blanks according to FIG. 2.

FIG. 3 shows how the blank 10 of FIG. 1 and the blank 110 of FIG. 2 of the described above allows a plurality of like carton blanks to be arranged in a nested relationship. FIG. 3 shows alternating columns of blanks 10 of FIG. 1 and columns of the blanks 110 of FIG. 2; a pair of columns of blanks 110 according to FIG. 2 are interposed with a column of blanks 10 according to FIG. 1.

The second cut-out 70A of the blank 10 can snugly receive the second lower tab 172C of the blank 110. The third cut-out 170C of the blank 110 can snugly receive the second upper tab 72C of the blank 10. The first cut-out 70 of the blank 10 can snugly receive the first upper tab 172 of the blank 110. The first cut-out 170 of the blank 110 can snugly receive the first upper tab 72 of the blank 10. The third cut-out 70C of the blank 10 can snugly receive the second upper tab 172 of the blank 110. The second cut-out 170A of the blank 110 can snugly receive the second lower tab 72C of the blank 10. The second partial cut-out 70D of a first one of the blanks 10 and the first partial cut-out 70B of a second, subsequent or sequential, one of the blanks 10 together can snugly receive the first lower tab 172B of the blank 110. The first partial cut-out 170B of a one of the blanks 110 and the second partial cut-out 170D of a second, subsequent or sequential, one of the blanks 110 together can snugly receive the first lower tab 72B of the second one of the blanks 110.

In this way the blank 10 of FIG. 1 and the blank 110 of FIG. 2 can be nested in a partially, longitudinally offset relationship to each other.

In alternative embodiments, a nested arrangement may be formed solely from a plurality of blanks 10 according to FIG. 1 (see FIG. 9) or only from a plurality of blanks 110 according to FIG. 2. In order to do so the alternate columns of blanks 10A, 10B are inverted with respect to their adjacent neighbours, as shown in FIG. 9.

Figure 9:
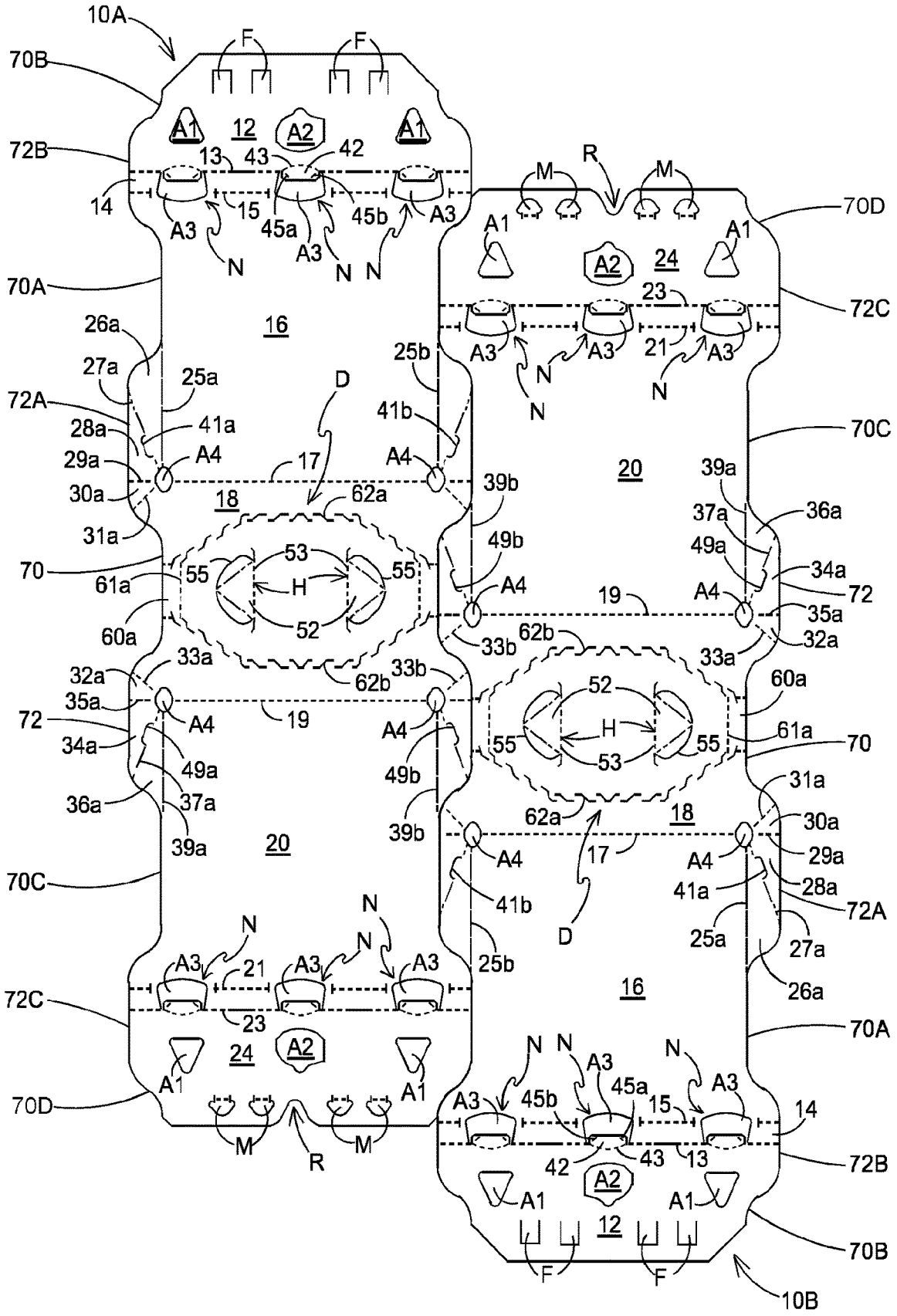
FIG. 9 is a plan view from above of a nested arrangement of a pair of blanks according to the first embodiment of FIG. 1, wherein one of the blanks is inverted with respect to the other blank.

As apparent from FIG. 3 and FIG. 9, a number of similar blanks 10; 110 can be horizontally arranged in a similar manner as described above so that they are efficiently taken from paperboard minimising or reducing the amount of waste material or scraps.

Construction of the cartons 90; 190 as illustrated in FIG. 4, 5A will be described with reference to the blank of FIG. 1 and the carton 90 of FIG. 5A. It will be appreciated the blank of FIG. 2 is constructed into the carton 190 of FIG. 4 in a substantially similar manner. The carton 90; 190 can be formed by a series of sequential folding operations in a straight-line machine so that the carton 90; 190 is not required to be rotated or inverted to complete its construction. The folding process is not limited to that described below and may be altered according to particular manufacturing requirements.

A group of articles B is assembled; in the embodiment illustrated in FIG. 5A six articles B are arranged in a 2×3 array. The top panel 18 of the blank 10 is disposed above the group of articles B to provide a top wall 18 of the carton 90.

The first and second side walls 16, 22 are folded, with respect to the top panel 18 about fold lines 17, 19 respectively, about opposing sides of the group of articles B so as to be disposed about the opposing sides of the group of articles B.

The anchor portions 26*a*, 26*b*, 36*a*, 36 may be folded into face contacting relationship with the respective one of the first and second side panel 16, 20 substantially simultaneously with folding the first and second side walls 16, 22 with respect to the top panel 18, to form the top engaging structures described above.

Alternatively, the top engaging structures may be formed subsequent to erection of the carton 90 into a tubular form. The anchor portions 26*a*, 26*b*, 36*a*, 36 may be tucked between the respective one of the first and second side panels 16, 20 to which they are hingedly connected and an adjacently disposed article B.

The first and second corner panels 114, 120 are folded, with respect to the respective one of the first and second side walls 16, 122 about fold lines 15, 21 respectively, about the heels or lower portions of adjacently disposed articles B.

The heel tabs 42 may folded out of the plane of the first and second corner panels 14, 20, about fold line 43, prior to folding the first and second corner panels 14, 20 the respective one of the first and second side walls 16, 122.

The first base panel 12 is folded about the fold line 13 so as to be disposed adjacent the base of the group of articles B, the second base panel 24 is then folded about the fold line 23 so as to be in at least partial overlapping relationship with the first base panel 12; in doing so each of the heel tabs 42 may be brought into engagement with a base of a respective article B.

The first and second base panels 12, 24 are secured together. Each of the male tabs M is displaced inwardly out of the plane of the second base panel 24. In so doing, each of the female tabs F is displaced inwardly creating a corresponding opening in the first base panel 12. The male tabs M are received in respective ones of the openings so as to lock the first and second base panels 12, 24 together. In this way a tubular structure is formed about the group of articles B.

The assembled carton 90 is shown in FIGS. 5A to 6B.

The present disclosure provides a carton 90; 190; 290 for packaging articles B. The carton 90 190; 290 is formed from a blank 10; 110; 210 which can be nested with like blanks each forming a carton 90; 190; 290.

First cartons 90; 190 are arranged to accommodate articles of a first dimension, second carton 290 is arranged to accommodate articles of a second different dimension. The cartons 90; 190; 290 comprise recessed side walls; the recesses in the side walls 16,20; 116,120 of the first cartons 90; 190 are arranged to commence at the same elevation above the base wall 12/24; 112/124 as recesses in the side walls 216, 220 of the second carton 290. In this way the blanks 10; 110; 210 and first and second cartons 90; 190; 290 can be handled and manipulated to form packages on the same packaging machine.

It can be appreciated that various changes may be made within the scope of the present invention. For example, the size and shape of the panels and apertures may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An elongate blank for forming a tubular carton, said blank comprising a plurality of panels including;

a top panel, a first side panel, a second side panel, a first base panel, and a second base panel, the plurality of panels arranged in a row along a length of the blank, said panels being hingedly connected one to another in series, each of said panels having a pair of opposed free end edges disposed generally along the length of the blank, said each panel being formed along either free end edge thereof with cut-outs so that said blank is provided along either longitudinal edge thereof with a plurality of tabs each interposed between adjacent ones of said cut-outs, said cut-outs including;

a first major cut-out struck from each of the opposed free end edges of the top panel, a second major cut-out struck from each of the opposed free end edges of the first side panel, a third major cut-out struck from each of the opposed free end edges of the second side panel, a first minor cut-out struck from each of the opposed free end edges of the first base panel, a second minor cut-out struck from each of the opposed free end edges of the second base panel, wherein the length of one of the free end edges of the first side panel defined by one of the second major cut-outs is less than the length of one of the free end edges of the second side panel defined by one of the third major cut-outs.

2. An elongate blank according to claim 1, wherein a first upper tab is hingedly connected in part to one of the first and second side panels and in part to the top panel.

3. An elongate blank according to claim 2, wherein a second upper tab is hingedly connected in part to the other one of the first and second side panels and in part to the top panel.

4. An elongate blank according to claim 1, wherein a first lower tab is hingedly connected in part to one of the first and second side panels and in part to one of the first and second base panels.

5. An elongate blank according to claim 4, wherein a second lower tab is hingedly connected in part to the other one of the first and second side panels and in part to the other one of the first and second base panels.

6. An elongate blank according to claim 3, wherein the length of the part of the first upper tab connected to one of the first and second side panels is less than the length of the part of the second upper tab connected to the other one of the first and second side panels.

7. An elongate blank according to claim 5, wherein the length of the part of the first lower tab connected to one of the first and second base panels is less than the length of the part of the second lower tab connected to the other one of the first and second base panels.

8. An elongate blank according to claim 1, wherein the second cut-outs each comprise an upper edge and a lower edge and the third cut-outs each comprise an upper edge and a lower edge, each of the lower edges of the second cut-outs being disposed at a first distance from an adjacent one of the first and second base panels, each of the lower edges of the third cut-outs being disposed at a second distance from an adjacent other one of the first and second base panels, the first distance being equal to the second distance.

9. An elongate blank for forming a tubular carton, said blank comprising a plurality of panels including;

a top panel, a first side panel hinged to a first side of the top panel, a second side panel hinged to a second side of the top panel, a first base panel hinged to the first side panel and a second base panel hinged to the second side panel, the plurality of panels arranged in a row along a length of the blank, said panels being hingedly connected one to another in series, each of said panels having a pair of opposed free end edges disposed generally along the length of the blank, said each panel being formed along either free end edge thereof with a cut-out so that said blank is provided along either longitudinal edge thereof with a plurality of tabs each interposed between adjacent ones of said cut-outs, wherein the arrangement of cut-outs and tabs is asymmetrical about a notional line which is transverse to the longitudinal edges and bisects the top panel.

10. A carton for packaging one or more articles, the carton comprising a plurality of walls including;

a top wall, a first side wall, a second side wall, a base wall, the carton comprising an article retention structure comprising a first top engaging structure and a second top engaging structure, the first top engaging structure comprising a first upper tab hingedly connected in part to a one of the first and second side walls and including;

a first anchoring portion hingedly connected to said one side wall;

a first gusset portion hingedly connected to the first anchoring portion;

a first web portion hingedly connected to the first gusset portion; and a first covering portion provided by a part of the top panel and hingedly connected to the first web portion;

the second top engaging structure comprising a second upper tab hingedly connected in part to the other one of the first and second side walls and including;

a second anchoring portion hingedly connected to said other side wall;

a second gusset portion hingedly connected to the second anchoring portion;

a second web portion hingedly connected to the second gusset portion; and a second covering portion provided by a part of the top panel and hingedly connected to the second web portion;

wherein the second anchoring portion is greater in dimension than the first anchoring portion.

11. A carton according to claim 10, wherein a hinged connection connecting the second anchoring portion to said other side wall is longer than a hinged connection connecting the first anchoring portion to said one side wall.

12. An elongate blank according to claim 1, wherein the first minor cut-out has a first linear dimension (D2b);

a first lower tab of the plurality of tabs is formed in part from the first base panel and in part from the first side panel and has a second linear dimension (D1);

the second major cut-out has a third linear dimension (A2);

a second upper tab of the plurality of tabs is formed in part from the first side panel and in part from the top panel and has a fourth linear dimension (C1);

the first major cut-out has a fifth linear dimension (B2);

a first upper tab of the plurality of tabs is formed in part from the second side panel and in part from the top panel and has a sixth linear dimension (B1);

the third major cut-out has a seventh linear dimension (C2);

a second lower tab of the plurality of tabs is formed in part from the second base panel and in part from the second side panel and has an eighth linear dimension (A1);

the second minor cut-out has a ninth linear dimension (D2a);

wherein the length of the blank is given by:

$$\text{length}=A1+A2+C1+C2+B1+B2+D2a+D2b+D1$$

and wherein

A1=A2

B1=B2

D1=D2a+D2b

C1=C2

C1>A2

C1>B1

(D2a+A1)=(D2b+D1).

13. An elongate blank according to claim 12, wherein the top panel comprises a width dimension (W3); the first minor cut-out and the first lower tab together define a tenth linear dimension (W2), where W2=D2b+D1); the second partial cut-out 70D and the second lower tab together define an eleventh linear dimension (W1), where W1=D2a+A1; the distance between the midpoint of the upper edge of the first lower tab and the fold line coupling the first side panel to the top panel defines a twelfth linear dimension (W5); the distance between the midpoint of the upper edge of the second lower tab and the fold line coupling the second side panel to the top panel defines a thirteenth linear dimension (W4); wherein the length of the blank is given by:

$$\text{length}=W1+W2+W3+W4+W5$$

and where:

$$W4=W5$$

$$W3+W4+W5=C2+B1+B2+C1+A2.$$

14. An elongate blank according to claim 13, wherein $$C2+B1=C1+A2$$

and where $$B2<W3.$$

* * * * *